US006870522B2

(12) United States Patent
Sagano et al.

(10) Patent No.: US 6,870,522 B2
(45) Date of Patent: Mar. 22, 2005

(54) IMAGE DISPLAY DEVICE AND METHOD OF ADJUSTING AN IMAGE DISPLAY DEVICE

(75) Inventors: Osamu Sagano, Tokyo (JP); Naoto Abe, Tokyo (JP); Hiroshi Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 330 days.

(21) Appl. No.: 10/256,426

(22) Filed: Sep. 27, 2002

(65) Prior Publication Data

US 2003/0063110 A1 Apr. 3, 2003

(30) Foreign Application Priority Data

Sep. 28, 2001 (JP) ..... 2001-304607
Sep. 24, 2002 (JP) ..... 2002-277830

(51) Int. Cl.[7] ..... G09G 3/22
(52) U.S. Cl. ..... 345/75.2; 345/98
(58) Field of Search ..... 345/75.2, 74, 74.1, 345/75.1; 313/309, 336, 495; 315/169.1, 169.3, 169.4, 174, 175

(56) References Cited

U.S. PATENT DOCUMENTS 5,734,361 A 3/1998 Suzuki et al. ..... 345/74
5,953,002 A * 9/1999 Hirai et al. ..... 345/204
6,195,076 B1 * 2/2001 Sakuragi et al. ..... 345/74.1
6,445,367 B1 * 9/2002 Suzuki et al. ..... 345/75.2
6,590,617 B1 * 7/2003 Kanai et al. ..... 348/625

FOREIGN PATENT DOCUMENTS

JP 08-248920 9/1996 ..... G09G/3/30

* cited by examiner

*Primary Examiner*—Vijay Shankar
*Assistant Examiner*—Nitin Patel
(74) *Attorney, Agent, or Firm*—Fitzpatrick, Cella, Harper & Scinto

(57) ABSTRACT

There is provided an image display device and a method of adjusting an image display device, in which a loss in brightness due to a voltage drop is compensated to thereby obtain an excellent image. In a construction having a plurality of display elements driven by means of a matrix wiring, images which are used for making adjustments reflecting a plurality of compensation conditions are displayed. A person making an adjustment selects an appropriate condition with a remote controller and a button. Thus, compensated image data adjusted according to the selected condition is obtained.

26 Claims, 25 Drawing Sheets

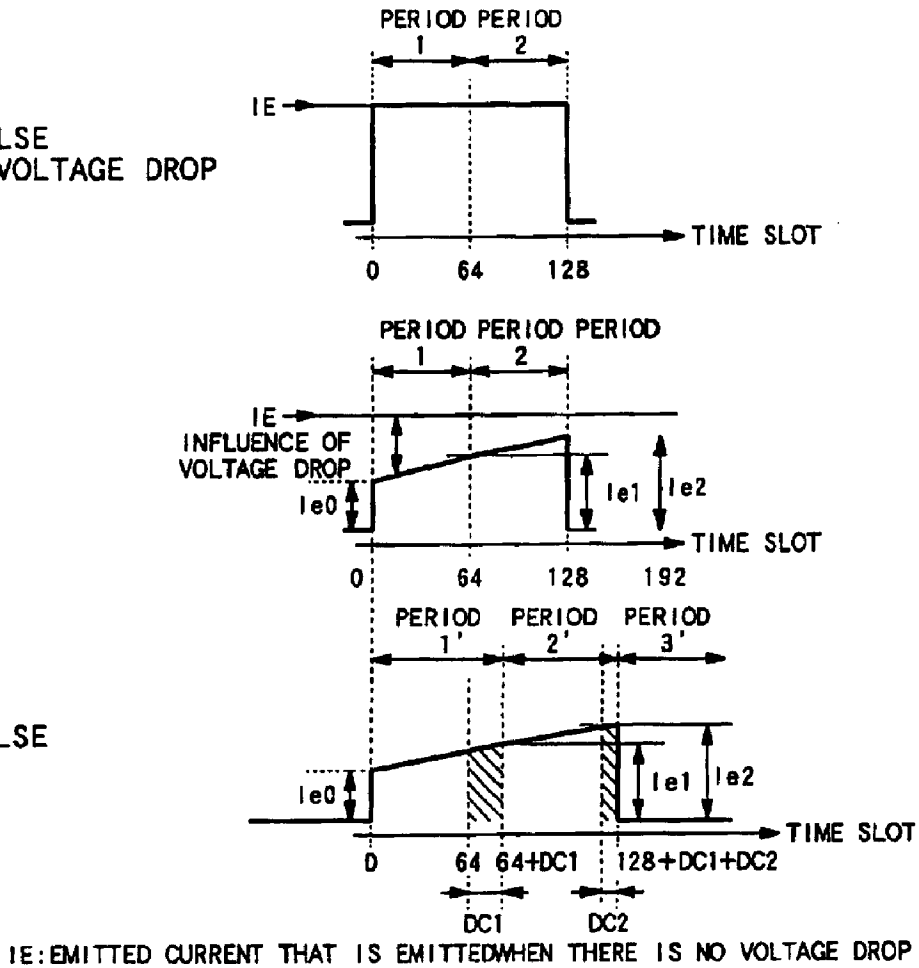
IE: EMITTED CURRENT THAT IS EMITTED WHEN THERE IS NO VOLTAGE DROP
FIG.10A EMITTED CURRENT PULSE WHEN THERE IS NOT VOLTAGE DROP
FIG.10B ACTUAL EMITTED CURRENT PULSE
FIG.10C EMITTED CURRENT PULSE AFTER COMPENSION

EMITTED CURRENT PULSE WHEN THERE IS NOT VOLTAGE DROP

ACTUAL EMITTED CURRENT PULSE

EMITTED CURRENT PULSE AFTER COMPENSION $$CA=((Xn+1-x)*CData[k][n]+(x-Xn)*CData[k][n+1])/(Xn+1-Xn)$$

$$CB=((Xn+1-x)*CData[k+1][n]+(x-Xn)*CData[k+1][n+1])/(Xn+1-Xn)$$

$$CD=CA*(Dk+1-data)+CB*(data-Dk)/(Dk+1-Dk)$$

IMAGE DISPLAY DEVICE AND METHOD OF ADJUSTING AN IMAGE DISPLAY DEVICE

BACKGROUND OF THE INVENTION

1. Field of the Invention

The present invention relates to an image display device using a display panel furnished with a plurality of display elements connected to form a matrix wiring, and a method of adjusting an image display device.

2. Description of the Related Art

Conventionally, an image display device is known which has N×M display elements that are wired to M row wirings and N column wirings and are arranged in a matrix layout, in which scanning is performed on the row wirings one after the other, and modulation is performed along the direction of the columns, thus simultaneously driving the element group in 1 line.

For example, JP 08-248920 A discloses an image display device which uses surface conduction electron-emitting devices as the display elements.

Also, JP 08-248920 A gives an example in which the image display device performs a compensation to achieve an excellent image display.

More specifically, JP 08-248920 A points out that a voltage drop occurs in a scan line and discloses a construction for performing a compensation which compensates for the voltage drop.

In contrast, the inventors of the present invention concentrated wholeheartedly on hardware for performing compensation described below in order to achieve an even better compensation.

Further, there are instances where the optimum compensation conditions differ due to individual differences in the characteristics of the image display devices, such as slight differences in wiring resistance levels.

There are also instances where the characteristics of the display elements used in the image display device deteriorate slightly when the used for a long period of time. When this occurred, the voltage drop amounts change causing the optimal compensation conditions to change slightly.

Further, there are unique problems which occur in image display devices having the construction which uses the matrix wiring to drive the display elements one line after the other. Specifically, the image display device possesses unique display characteristics due to influence of the voltage drop that is caused by the wiring resistance.

SUMMARY OF THE INVENTION

An object of the present invention is to realize an image display device that uses a matrix wiring to drive a plurality of display elements, having a construction in which a compensation condition for adjusting display characteristics can be determined in a favorable manner.

In order to attain the above-mentioned object, according to the present invention, there is provided an image display device comprising:

image display elements used for displaying an image, being driven via a plurality of row wirings and a plurality of column wirings constituting a matrix wiring;

a scanning circuit for sequentially selecting the row wirings; and a modulation circuit for providing to each of the plurality of column wirings a signal for modulating each of the plurality of image display elements connected to the row wiring selected by the scanning circuit, the device being characterized by having:

a pattern output circuit for image data for adjusting having been stored in advance;

a selection circuit for outputting image data inputted from an external of the image display device when performing a normal display, and outputting image data inputted from the pattern output circuit when adjusting a compensation condition; and a compensated image data calculation circuit for compensating image data inputted from the selection circuit to calculate compensated image data, wherein a compensation condition for making the compensation is selected according to an external control and the compensated image data calculation circuit calculates the compensated image data based on the selected compensation condition.

Here, light-emitting elements such as EL elements, for example, may be used favorably for the image display elements.

Further, even if the elements themselves do not emit a light, elements such as electron emitting elements which become light-emitting elements when combined with a phosphor, may be used favorable.

The construction of the present invention enables display of a plurality of adjustment data which reflect a plurality of compensation conditions for adjustment. Therefore, a person making the adjustment can select an appropriate compensation condition based on the adjustment images that reflect each of the adjustment compensation conditions.

In the normal image display state, even though a viewer may feel some sort of imperfection in the image, it is difficult to know how the state of the image display will change by modifying which compensation condition.

Since the present invention has a pattern output circuit it can display the adjustment images, and the differences among the compensation conditions can be grasped without looking at the images for a long period of time.

The compensation condition used for the adjustment image that was selected can be used as it is during normal display, at the compensated image data calculation circuit.

Further, modification of the compensation condition at the adjustment time can be achieved using a construction in which a signal from an external location (preferably a signal inputted by a person making the adjustment) is used to give an instruction as to which compensation condition to change to, or a construction in which compensated image data are outputted one after the other based on the plurality of compensation conditions even if there is no selection signal from the external location.

Further, although more detailed description will be provided in the embodiment later, when performing a compensation, when compensation data is computed to produce the image data to thereby generate compensated image data, there are cases where the compensated image data cannot be modulated in a favorable manner.

For example, when the compensated image data is generated by adding the compensation data to the image data, there are cases where the compensated image data exceeds a signal upper limit that the modulation circuit can modulate. In the case where the compensated image data has exceeded the upper limit, a display cannot be made which corresponds directly to the compensated image data. The inventors of the present application have invented a way to perform an adjustment in such a situation to realize the image display.

Selecting the strength of the adjustment described above, is one example of what is referred to in the present invention as selection of a compensation condition.

Further, the present invention is suitably applicable to a case in which the image display device further comprises a limiter for limiting so that compensated image data which is greater than a given value is not inputted into the modulation circuit.

Further, the present invention is suitably applicable to a case in which the compensated image data calculation circuit calculates compensated image data reflecting the compensation of the inputted image data, based on compensation data that is based on inputted image data and based on the selected compensation condition.

Further, a construction may be suitably employed in which the compensated image data calculation circuit calculates compensated image data which is obtained by compensating the inputted image data, based on compensation data for compensating for a voltage drop occurring in the row wirings and/or in the column wirings, and based on the selected compensation condition.

As described in detail below, in accordance with the matrix construction, when line-at-a-time driving method is performed by using a scanning circuit that selects and scans the row wirings (i.e., when a plurality of display elements on a row wiring selected by the scanning circuit are simultaneously given the modulation opportunity), the voltage drop in the row wirings is greater than the voltage drop in the column wirings, and it is easier for fluctuations in the drive conditions to occur. Therefore, it is preferable to perform a compensation which compensates for the voltage drop in the row wirings.

However, it is also possible to perform a compensation which compensates for the voltage drop in the column wirings, and a compensation which compensates for the voltage drop in both the row wirings and the column wirings.

There may be suitably employed a construction in which the compensated image data calculation circuit comprises a compensation data calculation circuit for calculating the compensation data, and an arithmetic circuit for computing the compensation data and the inputted image data, or also a construction in which the compensated image data calculation circuit further comprises an adjusting circuit for adjusting the output of the arithmetic circuit based on the selected compensation condition.

Note that, the adjustment of the arithmetic circuit's output may also be achieved by adjusting the data obtained before the image data and the compensation data are added together. In an embodiment explained below, the compensation data is adjusted before being computed with the image data, thereby achieving an adjustment of the output from the arithmetic circuit as a result.

Further, for the above-mentioned compensated image data calculation circuit, a construction may preferably be adopted in which the above-mentioned row wirings are divided into a plurality of blocks according to a plurality of reference points which are set along the same row wiring, and the voltage drop at each of the reference points is calculated based on signals for driving the image display elements within each of the blocks to thereby generate the above-mentioned compensation data corresponding to each of the reference points. At this time, the above-mentioned compensated image data calculation circuit may obtain the above-mentioned compensation data for positions other than the above-mentioned reference points by interpolating them based on the above-mentioned compensation data corresponding to the above-mentioned plurality of reference points.

As the construction in which the voltage drop at each reference point is calculated based on the signals for driving the image display elements inside each block to generate the above-mentioned compensation data corresponding to the respective reference points, a construction is preferably used in which the voltage drop at each of the reference points is predicted based on the number of image display elements inside each block which are illuminated at a given point in time (the electric current flowing to each block is determined by this number) to generate the compensation data for each reference point.

Further, the above-mentioned modulation circuit is a circuit for generating a pulse width modulation signal according to the inputted data, and the above-mentioned compensated image data calculation circuit preferably has a construction in which a plurality of the above-mentioned compensation data are generated for each of a plurality of discretely set points in time within the period during which the above-mentioned scanning circuit selects one of the row wiring. At this time, the above-mentioned compensated image data calculation circuit may obtain the above-mentioned compensation data for points in time other than the above-mentioned plurality of discretely set points in time by interpolating them based on the above-mentioned compensation data for the plurality of reference points.

Further, the present application includes the following invention(s) as a method(s) of adjusting an image display device:

According to the present invention, there is provided a method of adjustment for an image display device, comprising:

image display elements used in an image display and being driven via a plurality of row wirings and a plurality of column wirings constituting a matrix wiring;

a scanning circuit for sequentially selecting the row wirings; and a modulation circuit for providing to each of the plurality of column wirings a signal for modulating each of the plurality of image display elements that are connected to the row wiring selected by the scanning circuit;

the method being characterized in that:

a compensated image data calculation circuit which the image display device uses during a normal display time to display given adjustment images displays a plurality of adjustment images based on a plurality of adjustment data compensated according to a plurality of mutually different adjustment compensation conditions;

any one of the plurality of adjustment images is selected based on the display result, and the compensation condition that was used when the adjustment image that was selected was displayed is set as the compensation condition to be used by the circuit that calculates the compensated image data in which the inputted image data is compensated.

According to the present invention, a structure may be suitably employed in which the compensation is a compensation which includes dividing the row wiring into a plurality of blocks according to a plurality of reference points set along the same row wiring, calculating the voltage drop that will occur at each reference point based on a signal driving the image display elements within each of the blocks, and using the compensation data obtained with respect to each reference point.

At this time, there may be suitably employed a structure in which the compensation includes obtaining the compensation data for positions other than the reference points by interpolating it from the compensation data obtained for the plurality of reference points.

Further, a structure may be suitably employed in which the modulation circuit is a circuit for generating a pulse width modulation according to the inputted data, and to perform the compensation it generates a plurality of the compensation data each used respectively at a plurality of points in time which are set discretely within an interval when the scanning circuit selects one of the row wirings.

Further, a structure may be suitably employed in which the compensation includes obtaining the compensation data for points in time other than the plurality of discretely set points in time, by interpolating the compensation data based on the compensation data determined with respect to the plurality of reference points.

BRIEF DESCRIPTION OF THE DRAWINGS

In the accompanying drawings:

FIGS. 10A, 10B, and 10C are diagrams of an example of a calculation of compensation data in a case where image data has a size of 128;

DETAILED DESCRIPTION OF THE PREFERRED EMBODIMENTS

Hereinafter, explanation will be made of an image display device that uses surface conduction electron-emitting device as a display element. Here, as an example of a compensation, explanation will be made regarding an example in which influence from a voltage drop in row wirings (i.e., in scanning wirings) is compensated.

Hereinafter, detailed explanation will be made of a preferred embodiment of the present invention by way of example, with reference made to the drawings. However, the dimensions, materials, shapes, relative positions and such pertaining to the constitutive parts described in this embodiment are not intended to restrict the scope of the invention unless a particular delimiting recitation is made.

Embodiment 1

First, explanation will be made regarding Embodiment 1.

(General Overview)

In an image display device with cold cathode elements arranged in a passive matrix, an electric current flowing to the scanning wiring and wiring resistance of the scanning wiring cause a phenomenon to occur in which the voltage drops and the display image deteriorates. In order to overcome this problem, in accordance with an image display device according to an embodiment of the present invention, there is provided a processing circuit for favorably correcting the influence of the voltage drop in the scanning wiring on the display image, and a construction for achieving this with a circuit on a relatively small scale is adopted.

The circuit for making the compensation performs a predictive calculation about the deterioration of the display image which should occur due to the voltage drop based on input image data, and obtains compensation data for correcting the deterioration of the display image, and then carries out the compensation of the inputted image data.

To obtain an image display device with a built-in circuit for performing the above-mentioned compensation, the inventors have invested diligent research in an image display device according a system such-as is explained below.

Below, when explaining the present invention, an explanation will first be made regarding an overview of a display panel of the image display device according to the embodiment of the present invention, and electrical connections of the display panel, characteristics of surface conduction electron-emitting devices, a method for driving the display panel, a mechanism by which a drive voltage drops due to electrical resistance by the scanning wiring when an image is displayed by the above-mentioned display panel, and compensation method and device for correcting the influence of the voltage drop.

(Overview of the Image Display Device)

Figure 1:
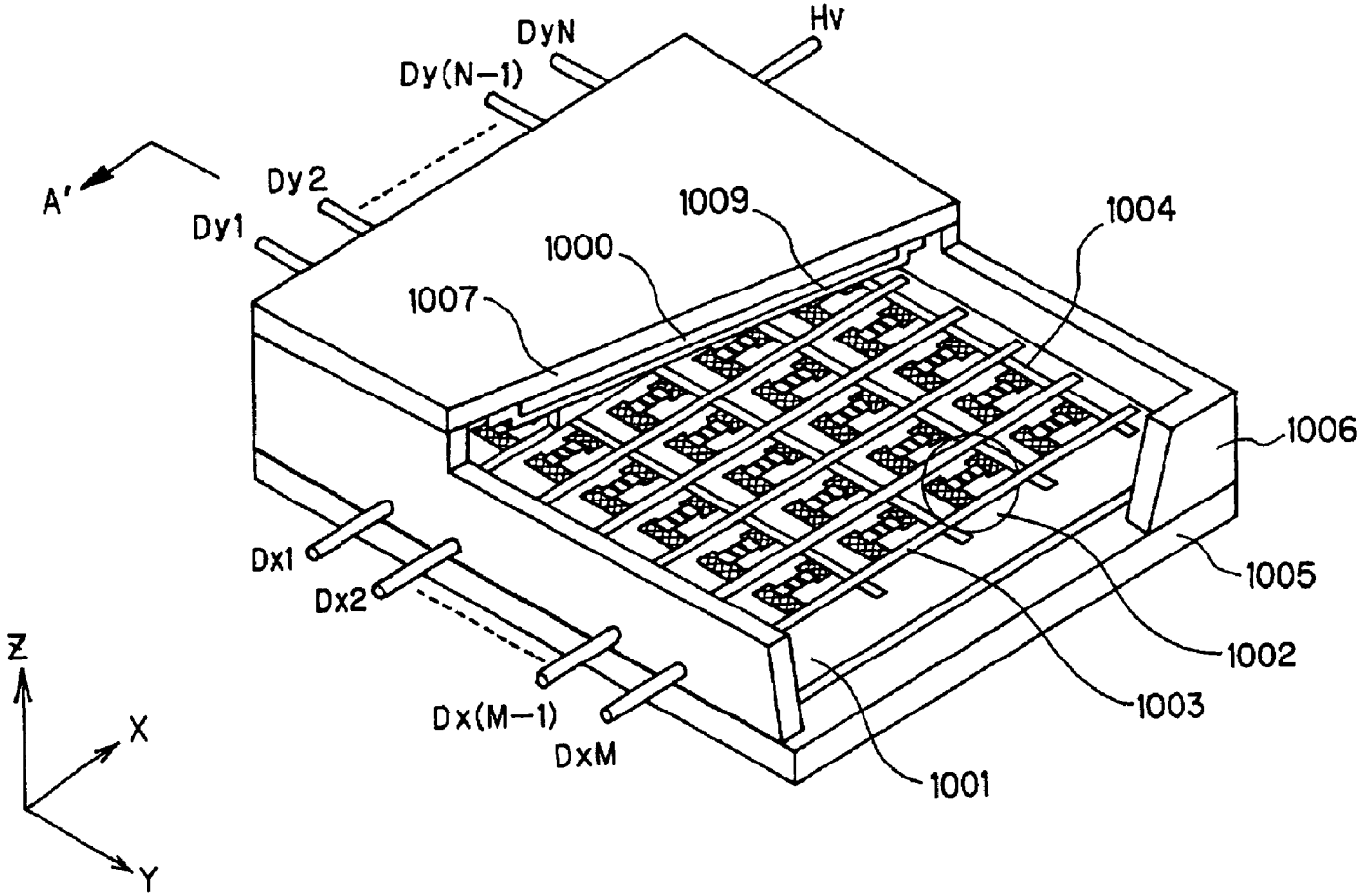
FIG. 1 is a diagram showing an overall view of an image display device according to an embodiment of the present invention.

FIG. 1 is a perspective view of the display panel using the image display device according to this embodiment. Note that, in order to show its internal construction, the display panel is presented with a part removed. In the diagram, a rear plate 1005, a sidewall 1006 and a face plate 1007 constitute an air tight container for maintaining the inner part of the display panel as a vacuum.

Figure 2:
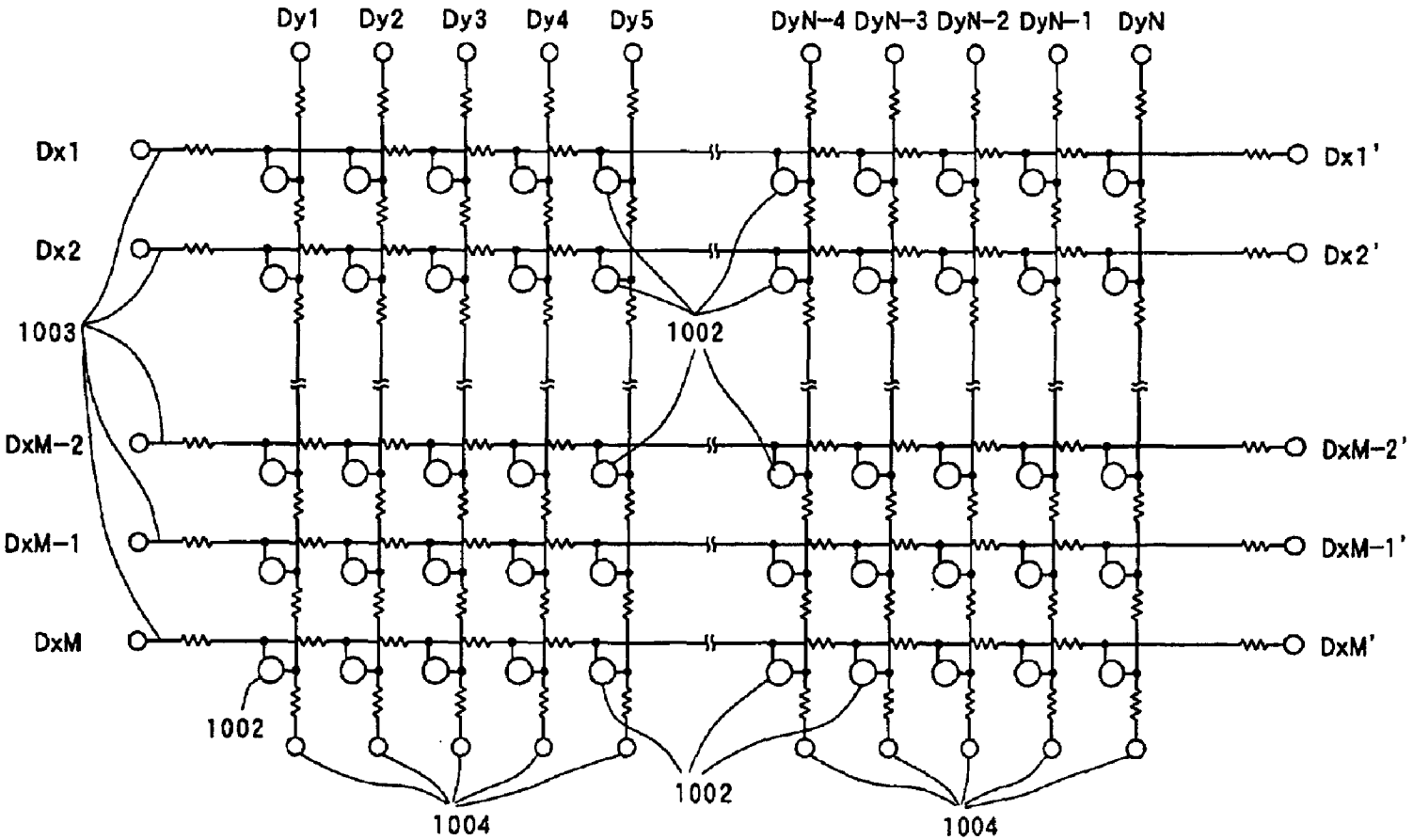
FIG. 2 is a diagram showing electrical connections of a display panel.

A substrate 1001 is fixed to the rear plate 1005. On the substrate 1001, there are formed N×M cold cathode elements 1002. Row wirings (scanning wirings) 1003, column wirings (modulation wirings) 1004 and cold cathode elements 1002 are connected as shown in FIG. 2.

A construction wired in this fashion is referred to as a passive matrix.

Further, on a bottom surface of the face plate 1007 there is formed a fluorescent film 1008. Since the image display device according to this embodiment is a color display device, phosphors of the fluorescent film 1008 portion are colored separately in three primary colors of red, green and blue. The cold cathode elements are formed in the matrix manner so as to correspond with each of the pixels (picture elements) on the rear plate 1005. The phosphors are constructed such that the pixels are formed at positions where emitted electrons (emitted electric current) that are emitted from the cold cathode elements will abut against the phosphors.

On a bottom surface of the fluorescent film 1008, there is formed a metal back 1009.

A high-voltage terminal Hv is electrically connected to the metal back 1009. By applying a high voltage to the high-voltage terminal Hv, the high voltage is applied between the rear plate 1005 and the face plate 1007.

In accordance with this embodiment, the surface conduction electron-emitting devices are made as the cold cathode elements inside the display panel described above. It is also possible to use as the cold cathode element a field emission device. Further, the present invention can also be applied in an image display device in which self light-emitting elements other than the cold cathode elements, such as EL elements, are connected to the matrix wirings, and the image display device is driven.

(Characteristics of the Surface Conduction Electron-emitting Devices)

Figure 3:
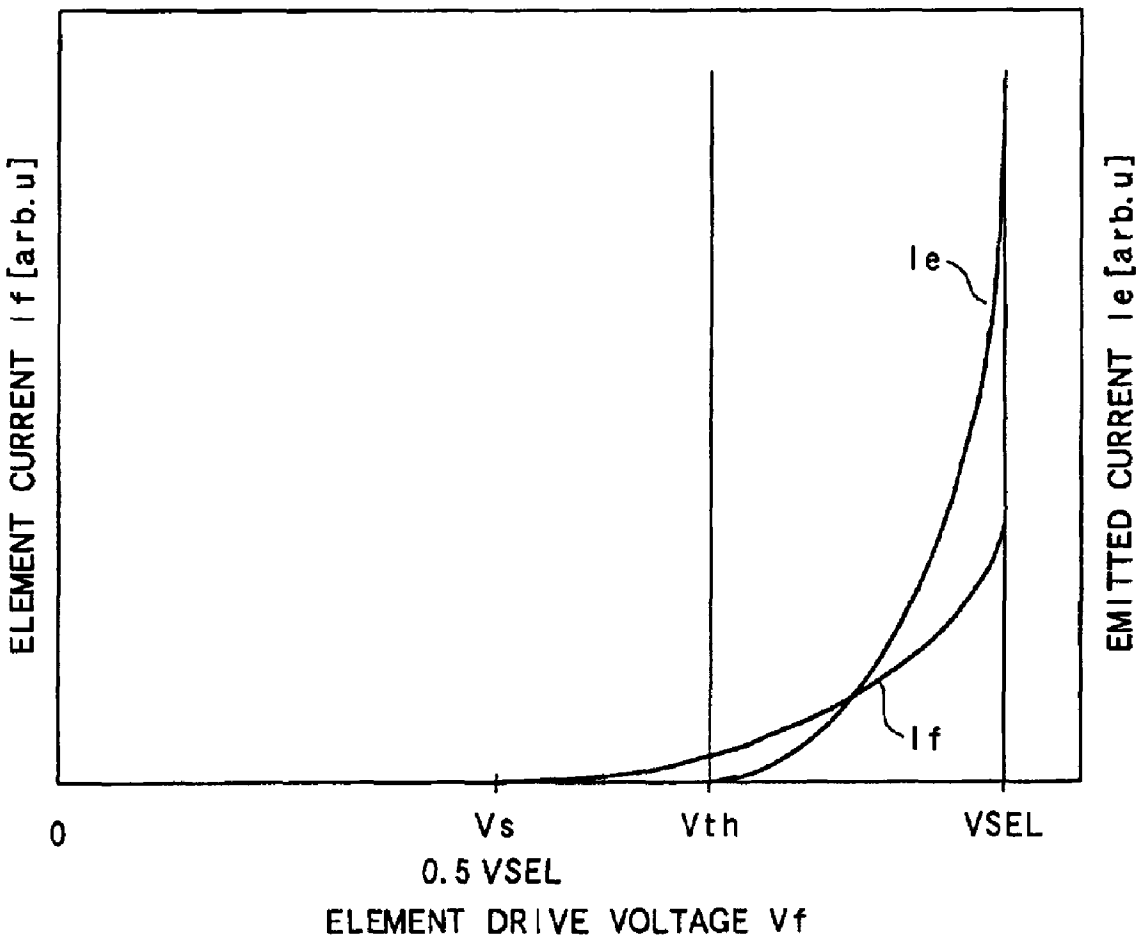
FIG. 3 is a diagram showing characteristics of a surface conduction electron-emitting device.

The surface conduction electron-emitting devices exhibit an emission current Ie/element application voltage Vf characteristic, and an element current If/element application voltage Vf characteristic, as shown in FIG. 3. Note that, the emission current Ie is much smaller than the element current If, and since it is difficult to show these currents in a diagram using the same scales, they are shown in two graphs using respectively different scales.

According to the graph shown in FIG. 3, the emission current Ie in the surface conduction electron-emitting devices exhibit the following three characteristics.

First, when a voltage equal to or greater than a given voltage (this will be referred to as a "threshold voltage Vth") is applied to the element, the emission current Ie increases dramatically. However, on the other hand, when a voltage that is less than the threshold voltage Vth is applied to the element, the emission current Ie is hardly detected.

In other words, the surface conduction electron-emitting device is a non-linear element having a clear threshold voltage Vth with respect to the emission current Ie.

Second, since the emission current Ie varies depending upon the voltage Vf that is applied to the elements, it is possible to control the amount of the emission current Ie by making the voltage Vf variable.

And third, since the surface conduction electron-emitting devices are also cold cathode elements, they have quick responsiveness which enables the emission time of the emission current Ie to be controlled by controlling the time when the voltage Vf is applied.

By taking advantage of the above-mentioned characteristics, the surface conduction electron-emitting devices can be used for the image display device in a favorable fashion. For example, in an image display device using the display panel shown in FIG. 1, if the first characteristic is used, it becomes possible to perform the display by progressive scanning the display screen. In other words, according to the desired luminance a voltage which is equal to or greater than the threshold voltage Vth is applied as appropriate to the element being driven, and a voltage below the threshold voltage Vth is applied to the elements which are in a non-selected state. By sequentially changing the element which is being driven, the display screen can be scanned sequentially to perform the display.

Further, by utilizing the second characteristic, the amplitude of the voltage Vf applied to the elements is controlled to thereby enable the luminous brightness of the phosphors to be controlled, thus enabling image displays at various brightness.

Further, by utilizing the third characteristic, the illumination time of the phosphors can be controlled with the time that the voltage Vf is applied to the elements, whereby image displays of various brightness can be performed.

In the image display device of the present invention, modulation was performed on the quantity of the electron beam of the display panel by using the above-mentioned third characteristic.

(Method of Driving the Display Panel)

Specific explanation of a method of driving the display panel of the present invention will be made using FIG. 4.

Figure 4:
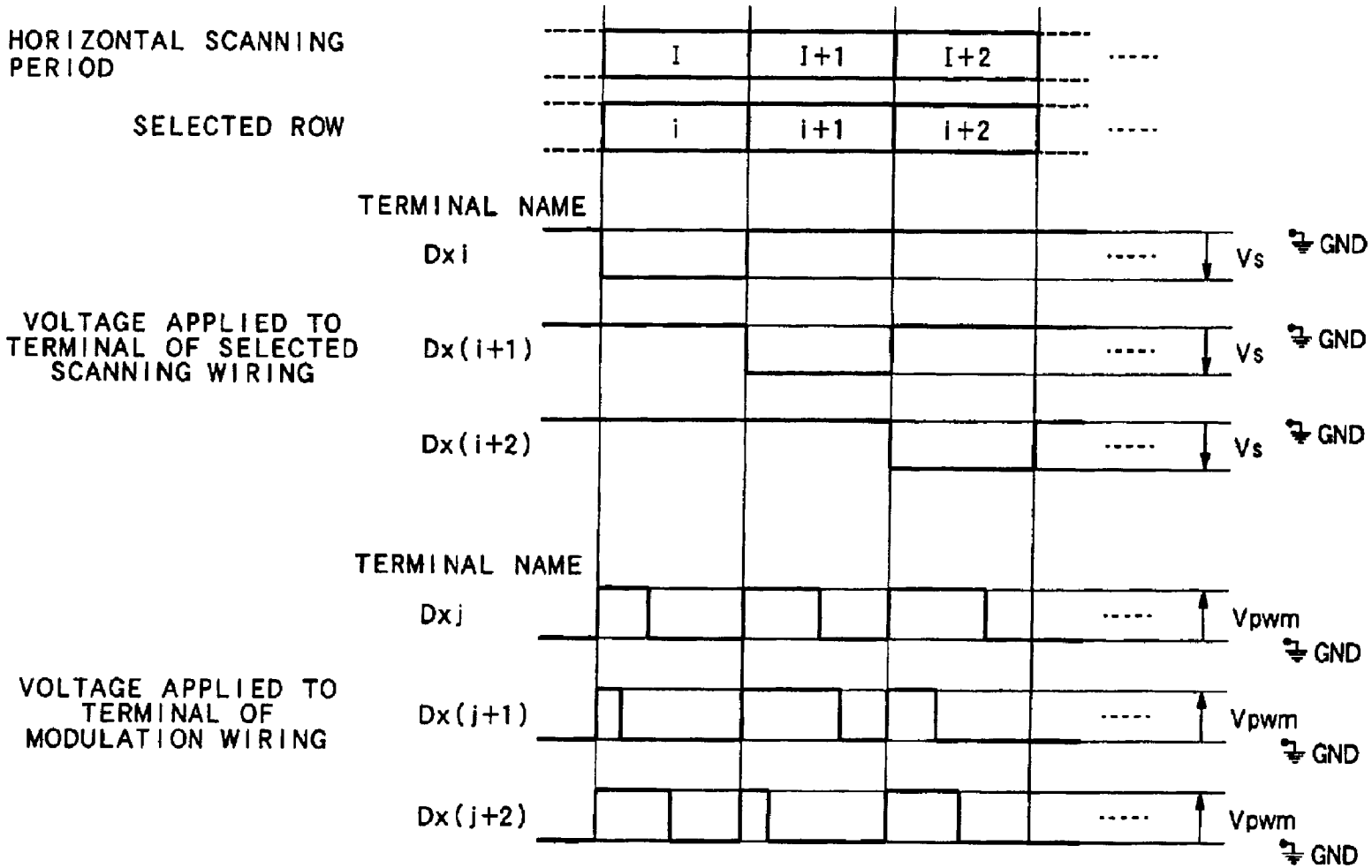
FIG. 4 is a diagram showing a method of driving the display panel.

FIG. 4 shows one example of a waveform of voltage applied to voltage supply terminals of the scanning wiring and the modulation wiring at a time when driving the display panel of the image display device according to the embodiment of the present invention.

Now, it is assumed that the current horizontal scanning period I is a period for making pixels in a line "i" illuminate.

In order to make the pixels in line i illuminate, the scanning wiring in line i is turned to a selected state, and a selection potential Vs is applied to its voltage supply terminal Dxi. Further, the voltage supply terminals Dxk (k=1, 2, . . . N, but≠i) for all the other scanning wirings are in non-selection states, and a non-selection potential Vns is applied to them.

In accordance with the present embodiment, a select potential Vs is set at $-0.5V_{SEL}$, which is half of the potential of a voltage $V_{SEL}$ shown in FIG. 3, and the non-selection potential Vns is set as a ground potential.

Further, a pulse-width modulation signal (i.e., a signal outputting one of a potential Vpwm and the ground potential) is supplied to a voltage supply terminal Dyj of the modulation wiring. In the conventional situation where compensations were not performed, the pulse width of the pulse-width modulation signal supplied to the j-th modulation wiring was determined according to the size of the image data at the pixel in line i at column j of the image to be displayed, and pulse-width modulation signals corresponding to the sizes of the image data at each of the pixels were supplied to all the modulation wirings.

Here, in accordance with the present invention, as described below, in order to correct the drop in the brightness due to the influence of the voltage drop, the pulse width of the pulse-width modulation signal supplied to the j-th modulation wiring is determined according to the size of the image data at the pixel in line i at column j of the image to be displayed, and in accordance with the compensation amount, and the pulse-width modulation signals are sent to all the modulation wirings. In accordance with this embodiment, the electric potential Vpwm is set at $+0.5V_{SEL}$.

In the surface conduction electron-emitting devices, when the voltage $V_{SEL}$ is applied between both ends of the element as shown in FIG. 3, electrons are emitted. However, when the applied voltage is smaller than Vth, no electrons are emitted at all.

Also, $V_{SEL}$ is set so that the voltage Vth becomes greater than $0.5V_{SEL}$, as shown in FIG. 3.

Therefore, electrons are not emitted from the surface conduction electron-emitting devices that are connected to the scanning wirings which are receiving the non-selection potential Vns.

Further, in the same way, in a period where the output from the pulse-width modulation means is at the ground potential (hereinafter, referred to as a period in which the output is "L"), the voltage applied to both ends of the surface conduction electron-emitting device connected to the selected scanning wiring is Vs. Therefore, it does not emit electrons.

The surface conduction electron-emitting device that is connected to the scanning wiring receiving the select potential Vs emits electrons depending on a period in which the output from the pulse-width modulation means is Vpwm (hereinafter, referred to as a period in which the output is "H"). When the above-mentioned phosphor is irradiated by the emitted electrons, the phosphor illuminates in accordance with the quantity of the emitted electron beam. Therefore, it can illuminate at a brightness that corresponds to the amount of time that the electrons are emitted.

The image display device according to the embodiment of the present invention also displays the image by performing scanning in linear sequence and pulse-width modulation on the display panel described above.

(Regarding Voltage Drop in the Scanning Wirings)

As described above, a basic problem in image display devices is that the voltage drop in the scanning wirings of display panel causes the electric potential along the scanning wirings to rise, whereby causing the electric voltage applied to the surface conduction electron-emitting devices to drop. Accordingly, the electric current emitted from the surface conduction electron-emitting devices decreases.

Below, explanation will be made regarding the mechanism of the voltage drop.

Although there are differences depending on the design specifications and manufacturing method of the surface conduction electron-emitting device, the electric current that flows to one of the surface conduction electron-emitting devices becomes about several 100 $\mu$A when the voltage $V_{SEL}$ is applied.

Therefore, during a given horizontal scanning period, when only 1 pixel on the selected scanning wiring is illuminated and the other pixels are not illuminated, the element current flowing from the modulation wiring to the selected scanning wiring is only the one corresponding to 1 pixel (i.e., the several 100 $\mu$A described above). Therefore, hardly any voltage drop occurs, and the illuminative brightness does not decrease.

However, during a given horizontal scanning period, when all the pixels on the selected scanning wiring are illuminated, the an electric current corresponding to all the pixels flows from all the modulation wirings to the selected scanning wiring. Therefore, the sum of the electric current becomes several 100 mA to several A, and wiring resistance in the scanning wiring causes the voltage drop in the scanning wiring to occur.

If the voltage drop on the scanning wiring occurs, the voltage applied to both ends of the surface conduction electron-emitting device drops. Accordingly, the electric current emitted from the surface conduction electron-emitting device decreases, and, as a result, the illuminative brightness decreases.

Figure 5A:
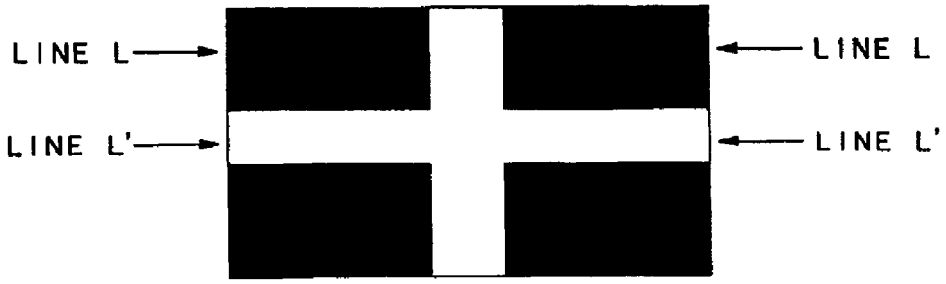
FIGS. 5A and 5B are diagrams for explaining an effect of a voltage drop.

Specifically, a case in which a pattern with a white cross shape on a black background is displayed as a display image as shown in FIG. 5A will be considered.

Figure 5B:
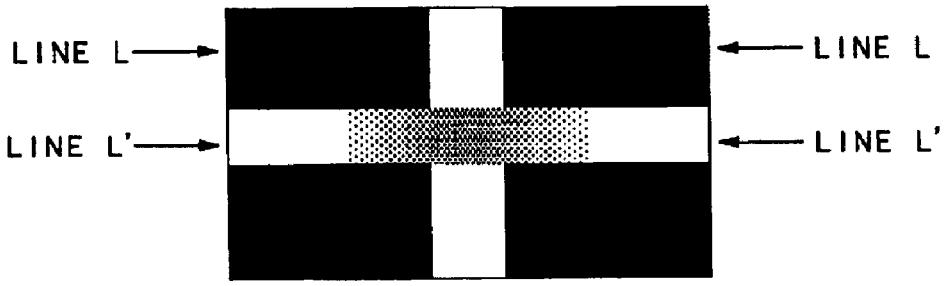

In such a case, when a line "L" indicated in FIGS. 5A and 5B is driven, the number of pixels which are lit up is small. Therefore, hardly any voltage drop occurs in the scanning wiring on this line. As a result, the desired amount of electric current is emitted from the surface conduction electron-emitting devices at each pixel, and the illumination at the desired brightness can be achieved.

On the other hand, when a line "L'" in the same diagram is driven, all the pixels light up simultaneously. Therefore, the voltage drop does occur in the scanning wiring, and the electric current emitted from the surface conduction electron-emitting devices of each pixel decreases. As a result, the brightness of the wiring at line L' decreases.

Thus, depending on differences in the image data at each of the horizontal lines, the influence suffered due to the voltage-drop would change, and therefore, when displaying a cross pattern as shown in FIG. 5A, an image as in FIG. 5B would be shown.

Note that this phenomenon is not limited to cross patterns, but also occurs in some cases when displaying, for example, a window pattern or a natural image.

Further, to complicate things further, when modulation is performed by means of the pulse width modulation, there are instances where the degree of the voltage drop changes during one horizontal scanning period.

FIG. 4 shows pulse-width modulation signals having pulse widths corresponding to the size of the inputted image data, and having their rising edges synchronized with each other. In a case where such pulse-width modulation signals are outputted to each column, differences will occur depending on the inputted image data, but, generally speaking, in one horizontal scanning period, the number of illuminated pixels is greatest immediately after the rising of the pulse. After the rising edge, the pixels go out in sequence starting with the least bright pixels. Accordingly, the number of illuminated pixels during one horizontal scanning period decreases as time passes.

Therefore, the degree of the voltage drop occurring in the scanning wiring also has a tendency to be greatest at the start of one horizontal scanning period, and then gradually diminish.

The output of the pulse-width modulation signals changes with each unit of time that corresponds to a single gradation in the modulation. Therefore, the chronological change in the voltage drops also occurs with each unit of time corresponding to a single gradation of the pulse width modulation signal.

The foregoing was an explanation of the voltage drop at the scanning wirings.

(Method of Calculating the Voltage Drop)

Next, detailed explanation will be made regarding a way of compensating for the influence of the voltage drop.

In order to derive a compensation amount for reducing the influence of the voltage drop, the inventors deemed that, as a first stage, it is necessary to develop hardware for predicting the degree of the voltage drop and its chronological change in real time.

However, the display panel of the image display device according to the embodiment of the present invention generally has several thousand modulation wirings. Thus, it is extremely difficult to calculate the voltage drops at points where all the modulation wirings intersect with the selected scanning wiring. Further, it is not realistic to manufacture hardware to calculate these in real time.

Instead, as a result of thinking about the voltage drop, the inventors came to understand the following characteristics.

i) At a given point in time in one horizontal scanning period, the amount of the voltage drop occurring in the scanning wiring is a spatially continuous amount therein, exhibiting an extremely smooth curve.

ii) The amount of the voltage drop changes with each unit of time corresponding to one gradation of the pulse width modulation, although it also varies depending on the display image. Overall, the degree of the voltage drop is largest near the rising edge of the pulse, and either reduces gradually with time, or maintains its degree.

In other words, according to the driving method shown in FIG. 4, the degree of the voltage drop during one horizontal scanning period does not increase.

Therefore, in light of the characteristics described above, the inventors have made studies so as to reduce the amount of calculations by performing an abbreviated calculation using an approximated model as described below.

First, in light of the characteristic described at "i)", when the degree of the voltage drop at a given point in time is to be calculated, a degeneracy model in which several thousand modulation wirings are concentrated into several to several tens of wirings to perform calculation in an approximately abbreviated manner.

Note that detailed explanation thereof will be made with reference to the calculation of the voltage drop according to the degeneracy model.

Next, in light of the characteristic described at "ii)", a plurality of different points in time are established within one horizontal scanning period, and the voltage drops at each of these times are calculated, whereby an overall prediction of the chronological changes in the voltage drop is made.

Specifically, by using a degeneracy model described below to calculate the voltage drops at a plurality of points in time, an overall prediction of the chronological change of the voltage drop is made.

(Calculation of the Voltage Drop Using the Degeneracy Model)

Figure 6A:
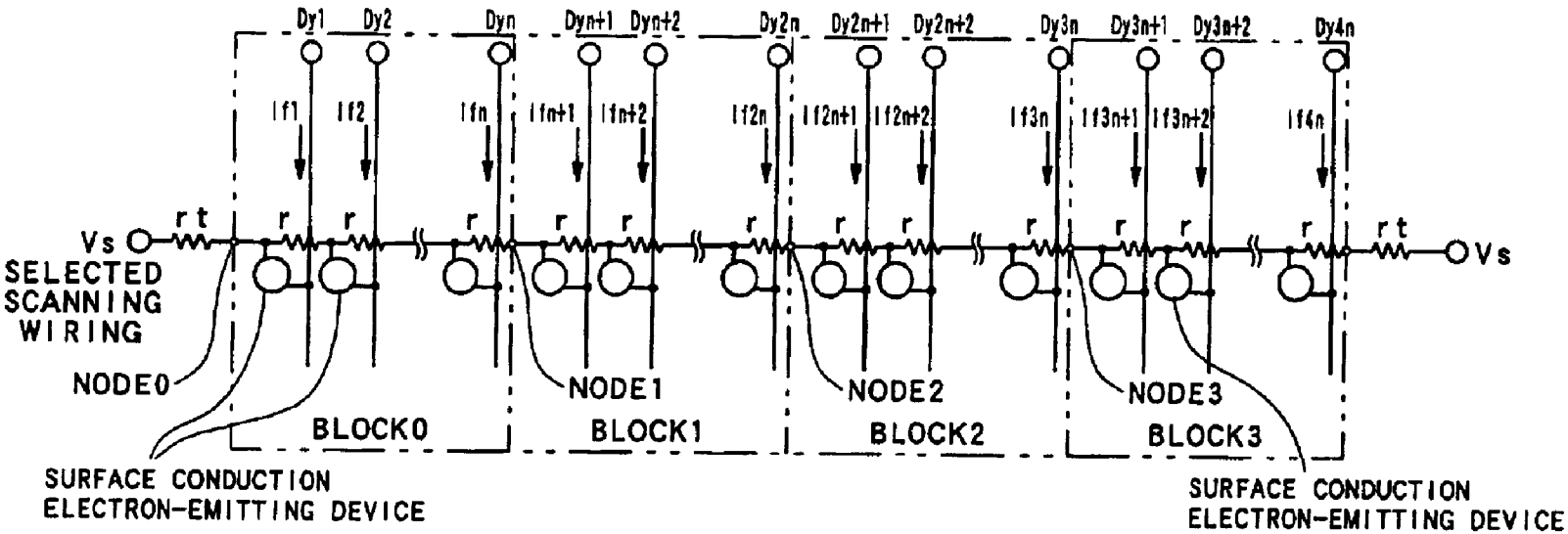
FIGS. 6A, 6B, and 6C are diagrams for explaining a degeneracy model.

FIG. 6A is a diagram for explaining blocks and nodes used when performing degeneration.

Figure 6B:
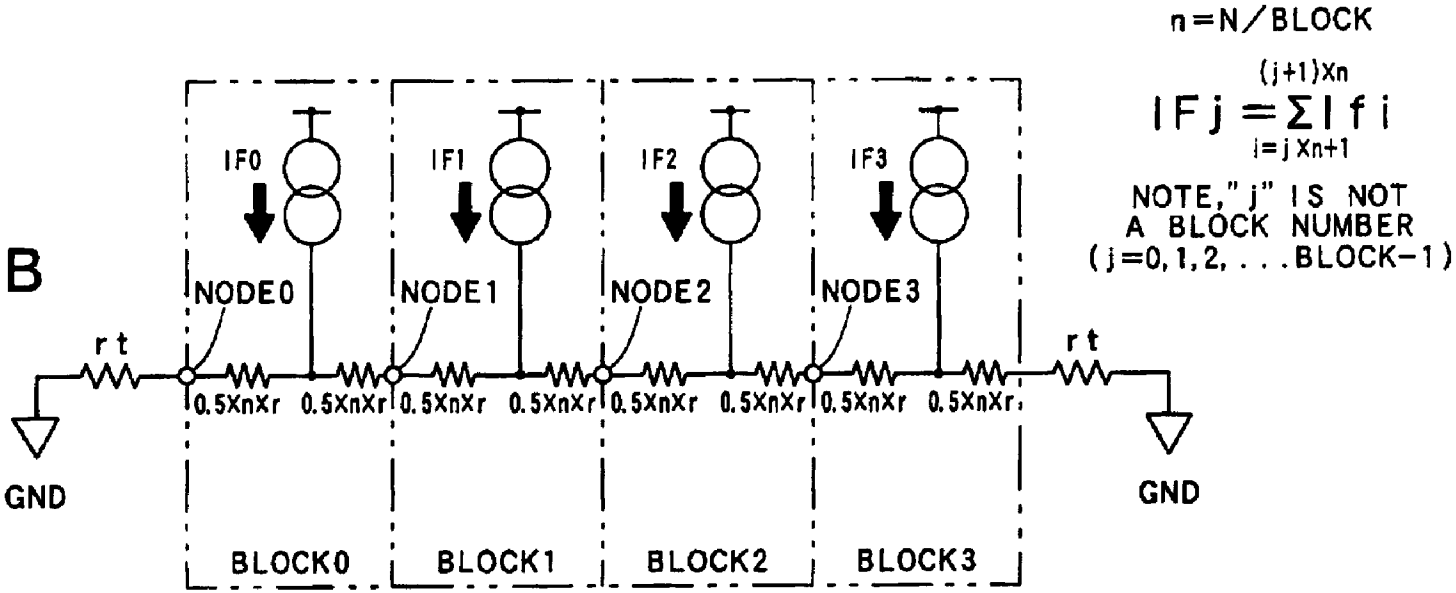
Figure 6C:
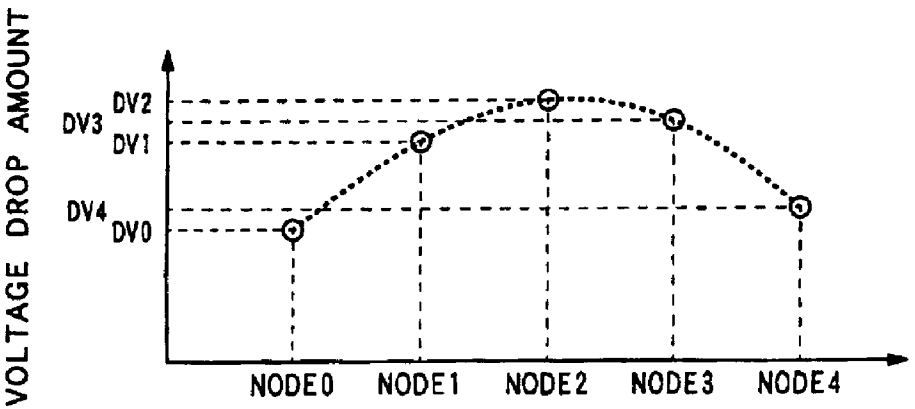

In order to abbreviate the diagram, only the selected scanning wiring, the modulation wirings and the surface conduction electron-emitting devices connected to their intersecting portions are shown in FIGS. 6A to 6C.

Now, the diagram shows a point in time during one horizontal scanning period, and it is assumed that the illumination state of each pixel on the selected scanning wiring (i.e., whether the output from the modulation means is "H" or "L") has already been determined.

In the illumination state, the element current flowing from each of the modulation wirings to the selected scanning wiring is defined as Ifi (where i=1, 2, . . . N, and i denotes a column number)

Further, as shown in the same diagram, n modulation wirings, a portion where the selected scanning wiring intersects with the n modulation wirings and the surface conduction electron-emitting device arranged at the intersection, are assumed to constitute one group that is defined as 1 block. In accordance with the present embodiment, the blocks are divided into 4 blocks.

Further, a position referred to as a "node" is established at the boundary positions of each block. The "node" refers to a horizontal position (reference point) for discretely calculating the amount of the voltage drop that will occur in the scanning wiring in the degeneracy model.

In accordance with the present embodiment, 5 nodes from a node 0 to a node 4 are established at the boundary positions of the blocks.

FIG. 6B is a diagram for explaining the degeneracy model.

In the degeneracy model, n modulation wirings included in 1 block in FIG. 6A are degenerated to 1 modulation wiring and this single degenerated modulation wiring is connected such that it is located in the center of the block on the scanning wiring.

Further, electric current sources are connected to the modulation wirings of each of the blocks which have been degenerated, and it is assumed that electric current total sums IF0 to IF3 in each of the blocks are flowing from the power sources.

Namely, Ifj (j=0, 1, 2, 3) is the electric current expressed as:

$$IFj = \sum_{i=j\times n+1}^{(j+1)\times n} Ifi \qquad \text{(Equation 1)}$$

Further the potential at both ends of the scanning wiring is Vs in FIG. 6A, but it is the ground potential in FIG. 6B. It is because, according to the degeneracy model, the electric current flowing from the modulation wiring to the selected scanning wiring is modeled according to the above-mentioned electric current source, whereby the voltage drop amount at each portion on the scanning wiring can be calculated by treating the electricity supply portion as a reference (ground) potential to calculate the voltages at each part (i.e., the difference between potentials at each part and the reference potential). In other words, the ground potential is determined as a reference potential for calculating the voltage drop.

Further, the reason why the surface conduction electron-emitting device is abbreviated is because from the perspective of the selected scanning wiring if an equivalent electric current flows in from the column wirings, the generated voltage drop itself will not change at all due to whether or not the surface conduction electron-emitting devices are provided. Therefore, the electric current value that flows in from electric current source of each block is set to the total electric current value (Equation 1) of the element currents in each block, whereby the surface conduction electron-emitting device can be abbreviated.

Further, the wiring resistance in the scanning wirings in each block is n-times the wiring resistance r of the scanning wiring in one section. (Here, a "section" refers an area from the intersection between the scanning wiring and a certain column wiring to the intersection with the next column wiring. Also, in the present example, the wiring resistances of the scanning wirings in one section are assumed to be equal to each other.)

In the above-mentioned degeneracy model, the voltage drop amounts DV0 to DV4 occurring at each node on the scanning wiring can be calculated in a simple fashion by using the following equation with product sum format:

$$DV0=a00\times IF0+a01\times IF1+a02\times IF2+a03\times IF3$$

$$DV1=a10\times IF0+a11\times IF1+a12\times IF2+a13\times IF3$$

$$DV2=a20\times IF0+a21\times IF1+a22\times IF2+a23\times IF3$$

$$DV3=a30\times IF0+a31\times IF1+a32\times IF2+a33\times IF3$$

$$DV4=a40\times IF0+a41\times IF1+a42\times IF2+a43\times IF3 \quad \text{(Equation 2)}$$

In other words, the following is established:

$$DVi=\sum_{j=0}^{3} aij\times IFj \quad \text{(Equation 3)}$$

$$(i=0, 1, 2, 3, 4)$$

However, in the degeneracy model, the "aij" refers to the voltage generated at the i-th node when the unit potential is applied only to j-th block. (This voltage is the difference between the potential at the i-th node and the potential at the reference position used for the voltage drop amount computation. The reference position for the voltage drop amount computation is located at the electricity supply portion of scanning wiring, and the potential at the reference position is the ground potential. Herein after, the foregoing will serve as the definition of "aij".)

The above-mentioned aij can be derived in a simple fashion according to Kirchhoff's Law as follows.

Namely, in FIG. 6B, if the wiring resistance up to the supply terminal on the left side of the scanning wiring as viewed from the electric current source in block i is defined as rli (i=0, 1, 2, 3), and the wiring resistance up to the supply terminal on the right side is rri (i=0, 1, 2, 3), and the wiring resistance between the block 0 and the left supply terminal and the wiring resistance between the block 4 and the right supply terminal are both defined as rt, then the following is established:

$$r10=rt+0.5\times n\times r$$

$$rr0=rt+3.5\times n\times r$$

$$rl1=rt+1.5\times n\times r$$

$$rr1=rt+2.5\times n\times r$$

$$rl2=rt+2.5\times n\times r$$

$$rr2=rt+1.5\times n\times r$$

$$rl3=rt+3.5\times n\times r$$

$$rr3=rt+0.5\times n\times r \quad \text{(Equation 4)}$$

Further, the following is supposedly set:

$$a=rl0//rr0=rl0\times rr0/(rl0\times rr0)$$

$$b=rl1//rr1=rl1\times rr1/(rl1\times rr1)$$

$$c=rl2//rr2=rl2\times rr2/(rl2\times rr2)$$

$$d=rl3//rr3=rl3\times rr3/(rl3\times rr3) \quad \text{(Equation 5)}$$

Therefore, aij can be derived in a simple fashion as in Equation 6. However, in Equation 6, A//B is a symbol expressing a resistance value parallel to resistance A and resistance B, where A//B=A×B/(A+B).

$$a00=a\times rt/rl0$$

$$a10=a\times(rt+3\times n\times r)/rr0$$

$$a20=a\times(rt+2\times n\times r)/rr0$$

$$a30=a\times(rt+1\times n\times r)/rr0$$

$$a40=a\times rt/rr0$$

$$a01=b\times rt/rl1$$

$$a11=b\times(rt+n\times r)/rl1$$

$$a21=b\times(rt+2\times n\times r)/rr1$$

$$a31=b\times(rt+n\times r)/rr1$$

$$a41=b\times rt/rr1$$

$$a02=c\times rt/rl2$$

$$a12=c\times(rt+n\times r)/rl2$$

$$a22=c\times(rt+2\times n\times r)/rl2$$

$$a32=c\times(rt+n\times r)/rr2$$

$$a42=c\times rt/rr2$$

$$a03=d\times rt/rl3$$

$$a13=d\times(rt+n\times r)/rl3$$

$$a23=d\times(rt+2\times n\times r)/rl3$$

$$a33=d\times(rt+3\times n\times r)/rl3$$

$$a43=d\times rt/rr3 \quad \text{(Equation 6)}$$

Even if the number of blocks is not 4, the definition of aij enables the calculation by using Equation 3 in a simple fashion using Kirchhoff's Law. Further, even in a case where the electricity supply terminals are not supplied to both sides of the scanning wiring as in the present embodiment, but are supplied to only one side thereof, the computation can be performed in a simple fashion by performing the calculation in accordance with the aij definition.

Note that, the parameter aij defined in Equation 6 does not need to be recalculated each time the calculation is performed. Rather, it may be calculated once and then stored as a table.

Further, the total sum electric currents IF0 to IF3 for each block as determined with Equation 1 are approximated as follows:

$$IFj=\sum_{i=j\times n+1}^{(j+1)\times n} Ifi=IFS\times\sum_{i=j\times n+1}^{(j+1)\times n} Counti \quad \text{(Equation 7)}$$

However, in Equation 7, Counti is a variable that will take a value of "1" when the "i"-th pixel on the selected scanning wiring is in the illuminated state, and will take a value of "0" when the pixel is in the turned-off state.

IFS denotes an amount produced when the element current IF flowing when the voltage $V_{SEL}$ is applied to both ends of one element of the surface conduction electron-emitting devices is multiplied by a coefficient a taking a value between 0 and 1.

In other words, it is defined as follows:

$$IFS=\alpha\times IF \quad \text{(Equation 8)}$$

The coefficient $\alpha$ is a coefficient for compensating the difference between the electric current amount that flows when there is no influence from the voltage drop and the electric current amount that is actually flowing. Therefore, the coefficient $\alpha$ value may be switched while various images having different voltage drop amounts (e.g., various images having average brightness that are different from the other) are displayed at each of the coefficient $\alpha$ values, and the optimum $\alpha$ value may be chosen based on these displays. Here, $\alpha$ is established as 0.7.

According to Equation 7, the element current proportionate to the number of pixels illuminated within a given block flows from column wirings of each block to the selected scanning wiring. Element current IF of one element which is multiplied by the coefficient $\alpha$ is set as the element current IFS of one element considering that the voltage in the scanning wiring increases due the voltage drop, thus reducing the amount of the element current.

FIG. 6C is a graph of results from calculating the voltage drop amounts DV0 to DV4 at each node in a certain illuminated state using the degeneracy model.

Since the voltage drop exhibits an extremely smooth curve, the voltage drops between nodes are presumed to take values indicated approximately by a dotted line in the diagram.

Thus, when the present degeneracy model is used, it is possible to calculate the voltage drop with respect to the inputted image data at the position of the node at desired points in time.

As described above, the voltage drop amount in a given illuminated state can be calculated in a simple fashion by using the degeneracy model.

Further the voltage drop that will occur on the selected scanning wiring changes chronologically within one horizontal scanning period. However, as described above, these changes are predicted by obtaining the illuminated states of several points in time within one horizontal scanning period, and using the degeneracy model to calculate the voltage drops exhibited in those illuminated states.

Note that, the number of illuminations within each block at a given point in time within one horizontal scanning period can be obtained in a simple fashion by referencing the image data at each block.

Now, as an example, it will be assumed that the number of bits of the data inputted into the pulse width modulation circuit is 8 bits, and the pulse width modulation circuit outputs a linear pulse width with respect to the size of the input data.

In other words, the input data is 0, the output is "L"; when the input data is 255, "H" is outputted during one horizontal scanning period; and when the input data is 128, "H" is outputted for the first half of one horizontal scanning period, and "L" is outputted for the last half thereof.

In a case as described above, the number of illuminations at the time when the pulse-width modulation signal is started (i.e., at the time of the rising edge in the modulation signal of the present example) can easily be detected by performing counting on the input data to the pulse-width modulation circuit are greater than 0.

Similarly, the number of illuminations at the central point in time in one horizontal scanning period can be detected easily by counting the number of input data to the pulse width modulation circuit that are greater than 128.

By comparing the image data with respect to a given threshold as described above, the number of illuminations in an arbitrary period of time can be counted easily by counting the number of outputs from the comparator that are positive.

Here, in order to simplify the following explanation, an amount of time referred to as a time slot will be defined.

Namely, a time slot is defined as an amount of time since a rising edge of the pulse-width modulation signal within one horizontal scanning period, and "time slot=0" indicates a point in time immediately following the start of the pulse-width modulation signal.

"Time slot=64" is defined as indicating a point in time where time corresponding to 64 gradations has elapsed since the start of the pulse-width modulation signal.

Similarly, "time slot=128" is defined as indicating a point in time where time corresponding to 128 gradations has elapsed since the start of the pulse-width modulation signal.

Note that, in accordance with the present embodiment, an example was given in which the pulse width modulation uses the rising-edge time as a reference, and the pulse width after that point in time is modulated. However, in a case where the falling-edge time of pulse is used as the reference to modulate the pulse width, the direction in which the time axis moves and the direction in which the time slot progresses will be opposite directions, but it goes without saying that the present invention may be applied nevertheless.

(Calculation of Compensation Data Based on the Voltage Drop Amount)

As described above, the degeneracy model is used to repeatedly perform calculations to approximately and discretely calculate the chronological changes exhibited by the voltage drops within one horizontal scanning period.

Figure 7:
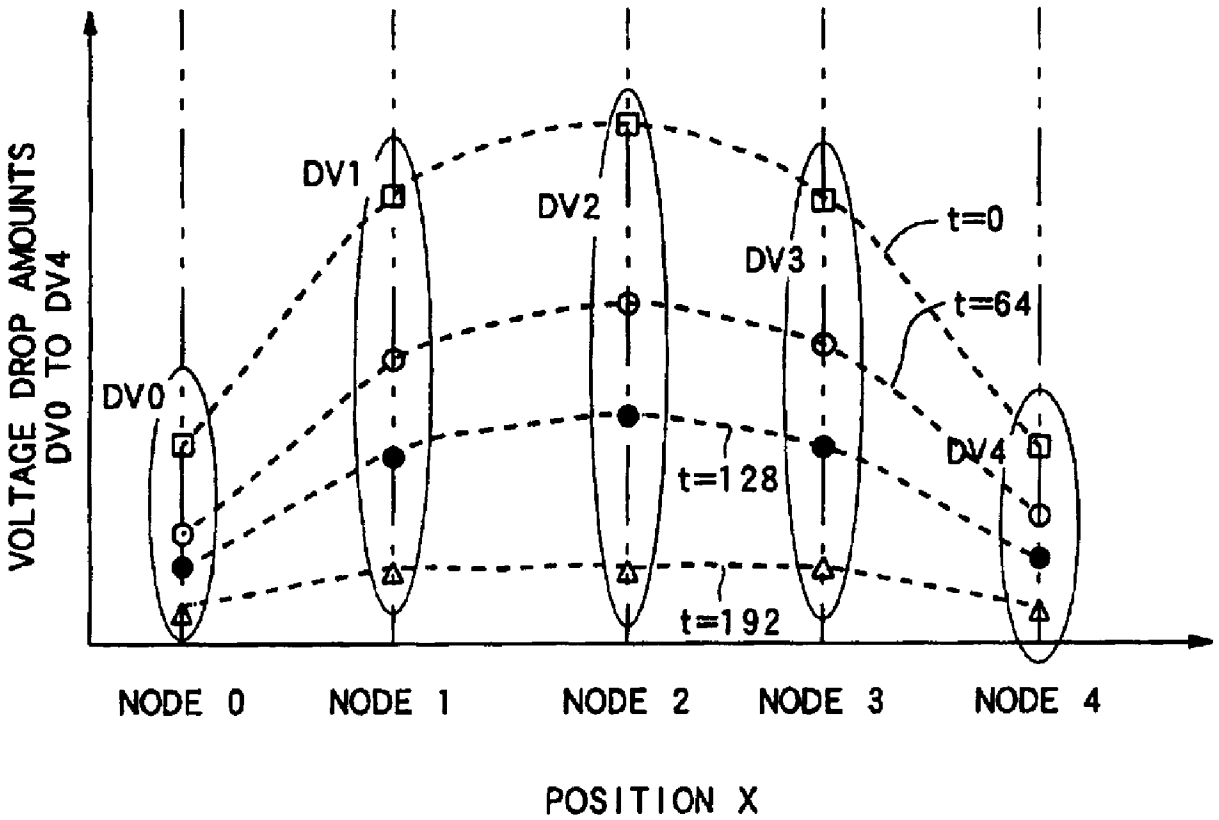
FIG. 7 is a graph showing discretely calculated voltage drop amounts.

FIG. 7 illustrates an example in which the voltage drops are repeatedly calculated with respect to given image data to calculate the chronological changes of the voltage drops in the scanning wiring (The voltage drops and their chronological changes shown here are one example given with respect to given image data, and it is natural that the voltage drops with respect to different image data will exhibit different changes.)

In FIG. 7, the degeneracy model is applied for calculation with respect to 4 points in time at which time slot is 0, 64, 128 and 192, respectively, and the voltage drop at each of those times is discretely calculated.

In accordance with FIG. 7, the voltage drop amounts at each node are connected by a dotted line. However, the dotted line is drawn only to make the diagram easier to look at. The voltage drops calculated using the present degeneracy model are each calculated discretely at each of the node positions which are indicated by the white squares, the white circles, the black circles and the white triangles.

Next, the inventors have made the following considerations for a method of calculating compensation data for compensating the image data based on the voltage drop amounts, as a subsequent stage at which the degree of the voltage drops and their chronological changes can be calculated.

Figure 8:
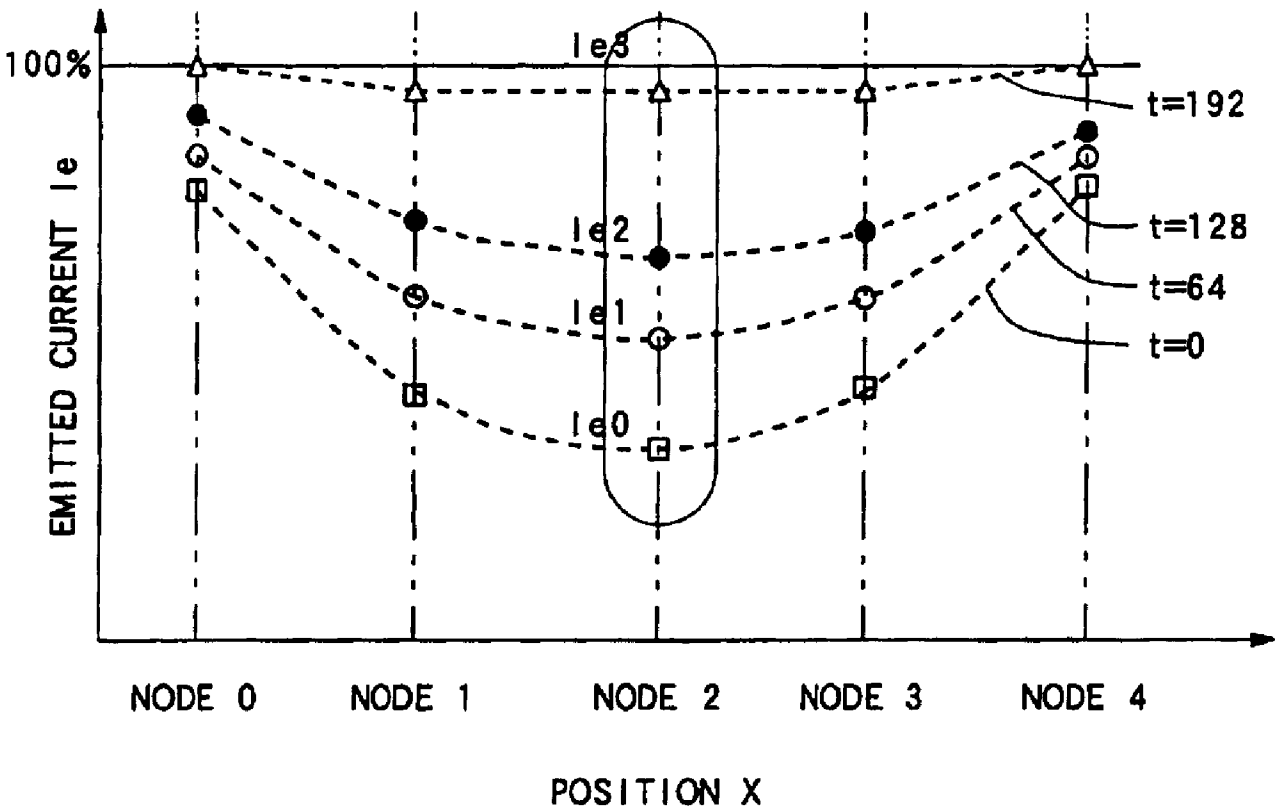
FIG. 8 is a graph showing discretely calculated amounts of changes in emitted currents.

FIG. 8 is a graph estimating the emission current that is emitted from a given surface conduction electron-emitting device in the illuminated state when the voltage drop shown in FIG. 7 occurs in the selected scanning wiring.

The vertical axis indicates the emitted current amount as percentages at each time and at each location where the degree of the emitted current that is emitted when there is not voltage drop is 100%. The horizontal axis indicates the horizontal positions.

As shown in FIG. 8, at the horizontal position (the reference point) at node 2, the following is established:
the emitted current when time slot=0 is Ie0;
the emitted current when time slot=64 is Ie1;
the emitted current when time slot=128 is Ie2; and
the emitted current when time slot=192 is Ie3.

Note that, the emitted current Ie shown in FIG. 8 is calculated from the graphs showing the voltage drop amounts in FIG. 7 and the "drive voltage/emitted current" shown in FIG. 3. Specifically, the value of the emitted current produced when the voltage calculated by subtracting the voltage drop amount from the voltage $V_{SEL}$ is applied, is simply plotted out mechanically.

Therefore, FIG. 8 primarily indicates the electric current that is emitted from the surface conduction electron-emitting device when it is in the illuminated state. The surface conduction electron-emitting devices in the turned-off state do not emit electric currents.

Hereinafter, explanation will be made regarding a method of calculating the compensation data for compensating the image data based on the voltage drop amount.

(Method of Calculating Compensation Data)

Figures 9A, 9B, 9C:
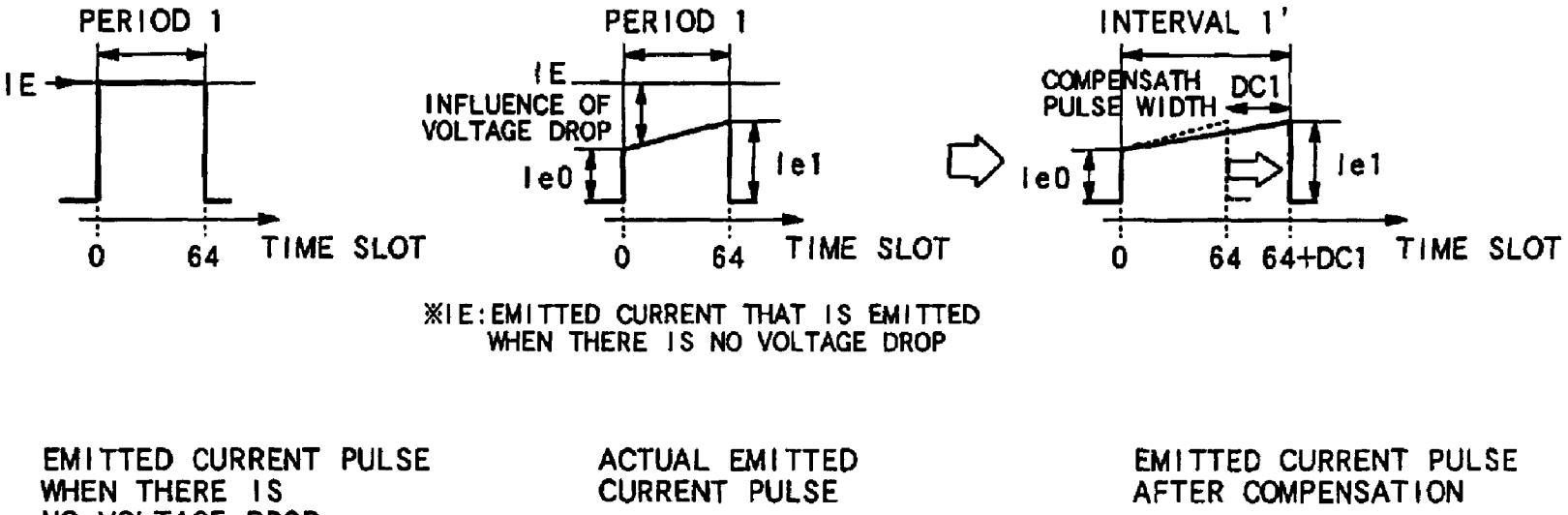
FIGS. 9A, 9B, and 9C are diagrams of an example of a calculation of compensation data in a case where image data has a size of 64.

FIGS. 9A, 9B and 9C are diagrams for explaining a method for calculating the voltage drop amount compensation data based on the changes with a time in the emitted current. These diagrams illustrate an example of calculating compensation data for compensating an image data having an inputted data size of 64.

The luminous amount of the luminance is equal to the emitted charge amount in which the emitted current from the emitted current pulse is integrated with a time. Therefore, when fluctuation in the luminance caused by the voltage drop is considered hereinafter, explanations will be made based on the emitted charge amount.

Now, in the case where there is no influence from the voltage drop, the emitted current is "IE". Further, if the amount of time corresponding to 1 gradation in the pulse width modulation is assumed to be Δt, then the emission charge amount Q0 which should be emitted by the emitted current pulse when the image data is 64 is expressed as follows. The emitted current pulse's amplitude IE times the pulse width (i.e., 64×Δt), which can be expressed as:

$$Q0=IE\times 64\times \Delta t \qquad \text{(Equation 9)}$$

However, in actuality, the voltage drop in the scanning wiring causes the electric current amount that is emitted from the element to drop.

In the following way, the amount of the emitted charge amount produced by the emitted current pulse can be approximately calculated in a way which takes the influence of the voltage drop into consideration: i.e., the emitted currents of the time slots 0 and 64 at node 2 are established as Ie0 and Ie1, respectively, and if the emitted current from 0 to 64 is approximated as a value changing in a linear fashion between Ie0 and Ie1, then the emitted charge amount Q1 during this period will exhibit a trapezoidal area shown in FIG. 9B.

In other words, the foregoing can be calculated as:

$$Q1=(Ie0+Ie1)\times 64\times \Delta t\times 0.5 \qquad \text{(Equation 10)}$$

Next, as shown in FIG. 9C, in order to compensate the amount of the emitted current that is caused by the voltage drop, the influence from the voltage drop can be removed by extending the pulse width by an amount equal to DC1.

Further, in the case where the compensation for the voltage drop is made and the pulse width is extended, it is considered that the emitted current amounts at each of the time slots will change. However, here, for the sake of simplicity, as shown in FIG. 9C, when the time slot=0, the emitted current is Ie0, and when the time slot=(64+DC1), the emitted current is Ie1.

Further, the emitted current between the time slot 0 and the time slot (64+DC1) is approximated as a value along a straight line connecting the emitted currents at these 2 points.

Therefore, the emitted charge amount Q2 produced by the emitted current pulse after the compensation can be calculated as:

$$Q2=(Ie0+Ie1)\times(64+DC1)\times \Delta t\times 0.5 \qquad \text{(Equation 11)}$$

If this is equal to the above-mentioned Q0, then $$IE\times 64\times \Delta t=(Ie0+Ie1)\times(64+DC1)\times \Delta t\times 0.5 \qquad \text{(Equation 12)}$$

When this is calculated with respect to DC1, $$DC1=((2\times IE-Ie0-Ie1)/(Ie0+Ie1))\times 64 \qquad \text{(Equation 13)}$$

Thus, the compensation data when the size of the image data is 64 is calculated as described above.

In other words, in the case of the image data with the size of 64 at the node 2 position, the compensation amount CData may be added until CData=DC1 as described in the formula 13.

FIGS. 10A to 10C are examples of calculation of the compensation data for image data having a size of 128, based on the calculated voltage drop amount.

Now, in the case where there is no influence from the voltage drop, the emitted charge amount Q3 that should be produced by the emitted current pulse when the image data is 128 is:

$$Q3\times IE\times 128\times \Delta t=2\times Q0 \qquad \text{(Equation 14)}$$

On the other hand, the emitted charge amount produced by the actual emitted current pulse having been influenced by the voltage drop can be approximately calculated in the following way.

Namely, the emitted current amounts at the time slots 0, 64 and 128 at node 2 are set to be Ie0, Ie1 and Ie2, respectively. Further, the emitted current during the period from time slot 0 to 64 alters a value on a straight line connecting Ie0 and Ie1, and if the emitted current during the period from time slot 64 to 128 is approximated as its value changing along the straight line between Ie1 and Ie2, then the emitted charge amount Q4 between the time slot 1 to 128 will be the sum of the two trapezoidal areas in FIG. 10B.

That is, it can be calculated as:

$$Q4=(Ie0+Ie1)\times 64\times \Delta t\times 0.5+(Ie1+Ie2)\times 64\times \Delta t\times 0.5 \qquad \text{(Equation 15)}$$

On the other hand, the voltage drop compensation amount was calculated as follows.

The interval corresponding to the time slots 0 to 64 is defined as an interval 1, and the interval corresponding to the time slots 64 to 128 is defined as an interval 2.

When the compensation has been carried out, the interval 1 portion is extended by an amount equivalent to DC1, thus being extended to an interval 1', and the interval 2 part is extended by an amount equivalent to DC2, thus being extended to an interval 2'.

At this time, by compensating each of the intervals, the emitted charge amount becomes the same as Q0 described above.

Further, it goes without saying that the emitted currents at the beginning and end of each interval are altered by performing the compensation. However, in order to simplify the calculations, it is assumed that these emitted currents do not change.

In other words, the emitted current at the beginning of the interval 1' is Ie0, and the emitted current at the end of the interval 1' is Ie1. The emitted current at the beginning of the interval 2' is Ie1, and the emitted current at the end of the interval 2' is Ie2.

As such, DC1 can be calculated in a fashion similar to Equation 13.

DC2 can also be calculated based on a similar approach:

$$DC2=((2\times IE-Ie1-Ie2)/(Ie1+Ie2))\times 64 \quad \text{(Equation 16)}$$

As a result, for the image data having the size of 128 at the node 2 position, it is sufficient to add the compensation amount CData that is equivalent to:

$$CData=DC1+DC2 \quad \text{(Equation 17)}$$

Figures 11A, 11B, 11C:
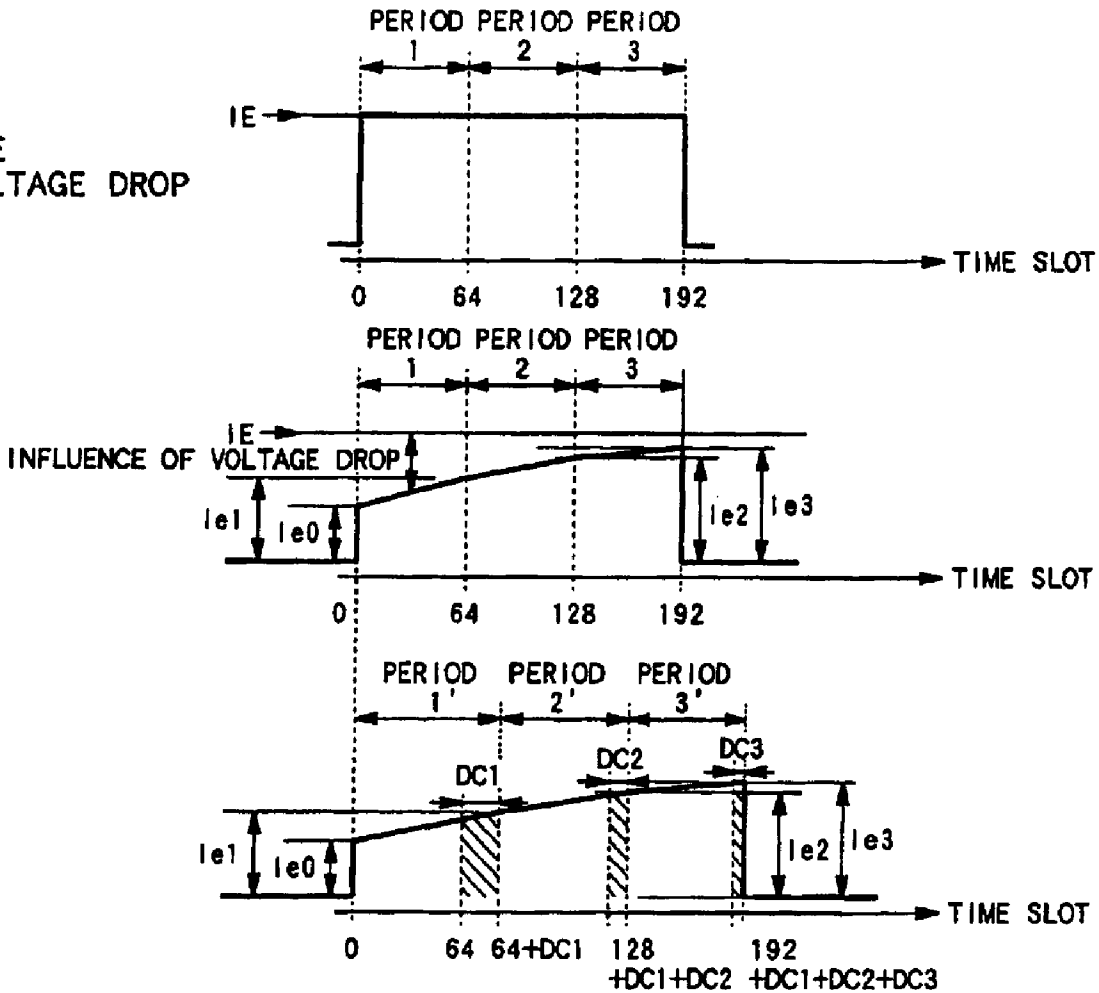
FIGS. 11A, 11B, and 11C are diagrams of an example of a calculation of compensation data in a case where image data has a size of 192.

FIGS. 11A to 11C are examples of calculating compensation data for image data having a size of 192, based on the calculated voltage drop amount.

Now, the emitted charge amount Q5 that will be produced by an emitted current pulse anticipated when the image data is 192 is:

$$Q5=IE\times 192\times \Delta t=3\times Q0 \quad \text{(Equation 18)}$$

On the other hand, the emitted charge amount produced by the actual emitted current pulse having received the influence by the voltage drop can be approximately calculated as follows.

Namely, during the time slots 0, 64, 128 and 192 for node 2, the emitted current amounts at each of these time slots is Ie0, Ie1, Ie2 and Ie3, respectively. Further, if the emitted current during the period from the time slot 0 to 64 is approximated as its value changing along a straight line connecting Ie0 and Ie1, and if the emitted current during the period from the time slot 64 to 128 is approximated as its value changing along a straight line connecting Ie1 and Ie2, and if the emitted current during the period from the time slot 128 to 192 is approximated as its value changing along a straight line connecting Ie2 and Ie3, then an emitted charge amount Q6 during a period from the time slot 0 to 192 will be as represented by the 3 trapezoidal areas in FIG. 11C.

In other words, the emitted charge amount Q6 can be calculated as:

$$\begin{aligned} Q6 = {} & (Ie0+Ie1)\times 64\times \Delta t\times 0.5 + \\ & (Ie1+Ie2)\times 64\times \Delta t\times 0.5 + \\ & (Ie2+Ie3)\times 64\times \Delta t\times 0.5 \end{aligned} \quad \text{(Equation 19)}$$

On the other hand, the voltage drop compensation amount can be calculated as follows.

The interval corresponding to the time slot 0 to 64 is defined as an interval 1, the interval corresponding to the time slot 64 to 128 is defined as an interval 2, and the interval corresponding to the time slot 128 to 192 is defined as an interval 3.

In the same manner as is described above, after the compensation has been carried out, the interval 1 part is extended by an amount equivalent to DC1, thus being extended to an interval 1', the interval 2 part is extended by an amount equivalent to DC2, thus being extended to an interval 2', and the interval 3 part is extended by an amount equivalent to DC3, thus being extended to an interval 3'.

At this time, by compensating each of the intervals, the emitted current amount becomes the same as Q0 described above.

Further, it has been temporarily assumed that the emitted currents at the beginning and the end of each interval remain unchanged before and after the compensation. That is, the emitted current at the beginning of the interval 1' is Ie0, and the emitted current at the end of the interval 1' is Ie1. The emitted current at the beginning of the interval 2' is Ie1, and the emitted current at the end of the interval 2' is Ie2. The emitted current at the beginning of the interval 3' is Ie2, and the emitted current at the end of the interval 3' is Ie3.

Therefore, DC1 and DC2 can each be calculated in the same ways as shown in Equation 13 and Equation 16.

Further, DC3 can be calculated as:

$$DC3=((2\times IE-Ie2-Ie3)/(Ie2+Ie3))\times 64 \quad \text{(Equation 20)}$$

As a result, the compensation data CData to be added to the image data having the size of 192 at the node 2 position can be calculated as:

$$CData=DC1+DC2+DC3 \quad \text{(Equation 21)}$$

The foregoing explains the calculation of the compensation data CData for the image data having the sizes of 64, 128 and 192 with respect to the node 2 position.

Further, when the pulse width is 0, it is obvious that the voltage drop has no influence on the emitted current. Therefore, the compensation data is 0, and the compensation data CData to be added to the image data is also 0.

Note that, the reason why the compensation data is calculated in this scattered fashion for image data 0, 64, 128 and 192 is to reduce the volume of the calculations.

In other words, if the same calculation were to be performed on all the image data, the volume of the calculations would become extremely large, and the amount of hardware for performing the calculations would become extremely great.

On the other hand, there is a tendency that the greater the image data at a given node position, the greater the compensation data will be. Therefore, when the compensation data for an arbitrary image data is to be calculated, the calculation volume can be significantly decreased by using a linear approximation to interpolate between points in the vicinity of the image data for which the compensation data has already been calculated. Note that the interpolation will be explained in detail when discrete compensated data interpolating means is explained.

Further, if the same approach is applied to all the node positions, the compensation data for the 0, 64, 128 and 192 image data at all the node positions can be calculated.

Note that the discrete image data for which the compensation data is calculated in the foregoing fashion is referred to as an image data reference value.

In accordance with this embodiment, the degeneracy model is applied with respect to the 4 time points at the time slots 0, 64, 128 and 192. By calculating the voltage drop amount which will occur at each of the time points, it becomes possible to obtain the compensation data for the reference values for the 4 image data 0, 64, 128 and 192.

However, it is preferable to reduce the intervals between the times when the voltage drops are calculated using the degeneracy model to deal more precisely with the time changes in the voltage drops. Further, although this will increase the number of discrete image data reference values, errors in the approximation calculations will be reduced.

Specifically, in FIGS. 9A to 11C, the calculations were performed only with respect to the 4 time slots 0, 64, 128 and 192 in order to simplify the diagrams. However, in actuality, when the calculations were performed at every 16 time slots between the time slot 0 and a time slot 255 (i.e., the reference values for the image data were set at a ratio of 1/16 the size of the image data), the errors in the approximation calculation were reduced even more. Note that, when this is performed, Equations 9 to 21 may be modified according to the same approach to perform the calculations.

Figure 12A:
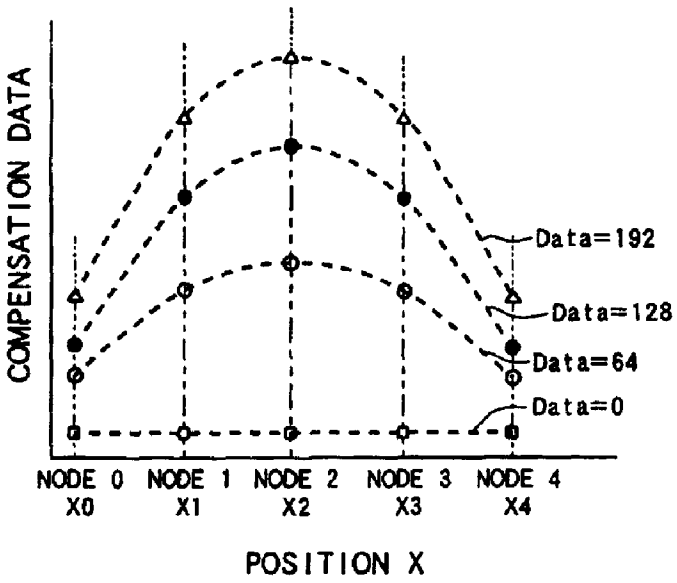
FIGS. 12A and 12B are diagrams for explaining a method of interpolating the compensation data.

FIG. 12A is an example resulting from using the above-mentioned method on given inputted image data, to discretely calculate the compensation data CData for image data 0, 64, 128 and 192 at each node position. Note that, in FIG. 12A, in order to make the diagram easier to see, discrete compensation data calculated with respect to the same image data are drawn connected to each other by dotted curved lines.

(Method of Interpolation Discrete Compensation Data)

The compensation data that is discretely calculated is discrete with respect to each of the node positions. The compensation data do not provide compensation data for arbitrary horizontal positions (i.e., column wiring numbers). Further, the discretely calculated compensation data is compensation data for image data having sizes equal to several reference values determined in advance for each node position. The compensation data does not provide compensation data for the actual image data size.

Therefore, the inventors interpolated the discretely calculated compensation data to calculate compensation data that is appropriate for the size of the input image data on each of the column wirings.

Figure 12B:
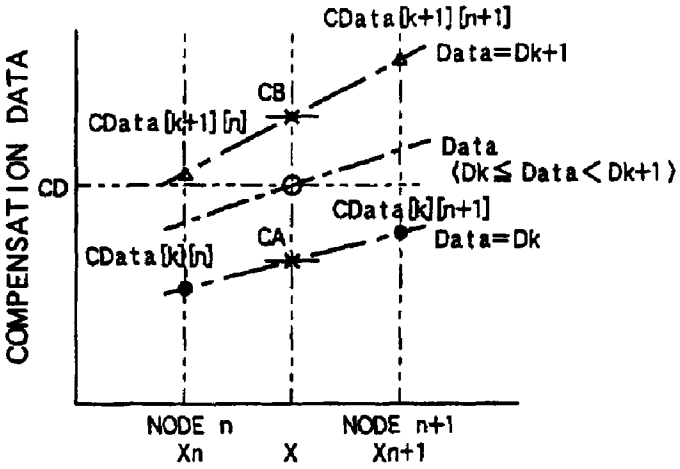

FIG. 12B is a diagram showing a method for calculating compensation data corresponding to image data "Data" at a position x located between a node n and a node n+1.

Note that it is presumed that the compensation data has already been discretely calculated for positions Xn and Xn+1 at the node n and at the node n+1.

Further, the inputted image data Data has a value between image data reference values Dk and Dk+1 for which discrete compensation data have already been calculated.

Now, if the discrete compensation data for the reference value for the "k"-th image data at the node n is written as CData [k] [n], then the compensation data CA for the pulse width Dk at the position x can be calculated in the following way according to the linear approximation using the values of CData [k] [n] and CData [k] [n+1].

Namely, $$CA = \frac{(X_{n+1} - x) \times CData[k][n] + (x - X_n) \times CData[k][n+1]}{X_{n+1} - X_n} \quad \text{(Equation 22)}$$

However, Xn and Xn+1 are the horizontal display positions for the nodes n and (n+1), respectively, being constants determined when the block above is determined.

Further, compensation data CB for image data Dk+1 at the position x can be calculated as follows.

Namely, $$CB = \frac{(X_{n+1} - x) \times CData[k+1][n] + (x - X_n) \times CData[k+1][n+1]}{X_{n+1} - X_n} \quad \text{(Equation 23)}$$

By linearly approximating the compensation data CA and CB, the compensation data CD for the image data Data at the position x can be calculated as follows.

Namely, $$CD = \frac{CA \times (D_{k+1} - \text{Data}) + CB \times (\text{Data} - D_k)}{D_{k+1} - D_k} \quad \text{(Equation 24)}$$

As described above, in order to calculate the compensation data from the discrete compensation data such that the compensation data is appropriate for the actual position and the actual image data size, the calculations can be performed easily by using the methods written in Equations 22 to 24.

The compensation data thus calculated is added to the image data to compensate the image data, and if the pulse width modulation is performed in accordance with the post-compensated image data (referred to as the "compensated image data"), the conventional problem of the influence from the voltage drop in the display image can be reduced, and the image quality can be improved.

Further, the conventional problem of the hardware for performing the compensation can also be solved by introducing the degeneracy or other such approximation as described above, to thereby reduce the volume of the calculations. Simultaneously, the hardware for performing the compensation can be achieved in an extremely small scale.

(Overall System and Explanation of Functions of Each Part)

Next, explanation will be made regarding a hardware of an image display device with a built-in correction data calculation circuit.

Figure 13:
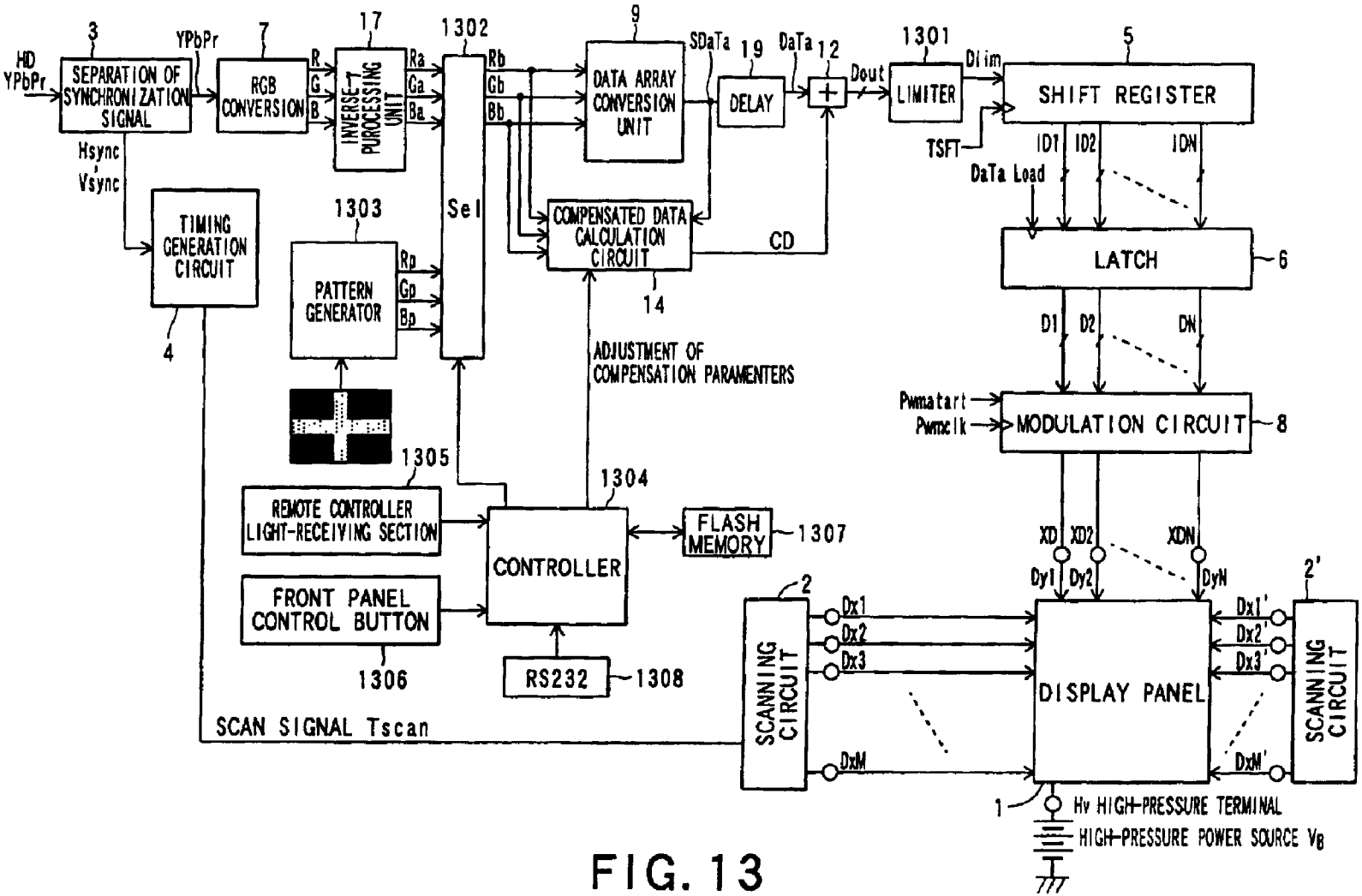
FIG. 13 is a block diagram showing an outline construction of the image display device with a built-in compensation circuit.

FIG. 13 is a block diagram illustrating an outline of its circuit structure. The circuit is substantially composed of the display panel 1 shown in FIG. 1; voltage supply terminals Dx1 to DxM, and Dx1' to DxM', of the scanning wirings in the display panel; voltage supply terminals Dy1 to DyN of the modulation wirings in the display panel; a high-voltage supply terminal Hv for applying accelerating voltage between the face plate and the rear plate; a high-voltage source Va; a scanning circuit 2; a synchronization signal isolating circuit 3; a timing generation circuit 4; a conversion circuit 7 for converting a YPbPr signal into an RGB signal by means of the synchronization isolating circuit 3; an inverse-γ processing unit 17; an image data single-line shift resistor 5; an image data single-line latch circuit 6; a pulse width modulation circuit 8 for outputting a modulation signal to the modulation wirings of the display panel 1; an adder 12; a compensated data calculation circuit 14; and a delay circuit 19. A compensated image data calculation circuit is composed of the adder 12 and the compensated data calculation circuit 14.

Further, in FIG. 13, the input image data R, G and B are parallel data. Image data Ra, Ga and Ba are RGB-parallel data produced by the input image data RGB undergoing the inverse-γ conversion processing by the inverse-γ processing unit 17 described below. The image data Data is data which has been parallel/serial-converted by a data array conversion unit. The compensation data CD is data calculated by compensation data calculating means. Compensated image data "Dout" is data calculated by the adder 12 adding the compensation data CD to the image data Data.

(Synchronization Isolating Circuit, Timing Generation Circuit)

The image display device of this embodiment can display NTSC, PAL, SECAM, HDTV and other such television signals, and also computer outputs such as VGA and the like.

In FIG. 13, only the HDTV format is shown in order to simplify the diagram.

In the HDTV format image signal, first the synchronization isolating circuit 3 separates synchronization signals Vsync and Hsync from each other. The separated synchronization signals Vsync and Hsync are provided to the timing generation circuit 4. The image signal YPbPR which has been isolated from its synchronization signals is provided to the RGB conversion means. Inside the RGB conversion means 7 there are provided a conversion circuit for converting from the image signal YPbPR to the input image data RGB, and also a low-pass filter not shown in the diagram and an A/D converter and the like, and the RGB conversion means converts the image signal YPbPR to a digital RGB signal and provides this to the inverse-γ processing unit 17.

(Timing Generation Circuit)

The timing generation circuit 4 has a built-in PLL circuit, and it generates timing signals synchronized to synchronization signals from various image sources and generates operation timing signals for each part.

Examples of timing signals generated by the timing generation circuit 4 include a TSFT for controlling operating timing of the shift resistor 5; a control signal Dataload for latching data from the shift resistor 5 to the latch circuit 6; a pulse width modulation start signal Pwmstart for the modulation circuit 8; a clock Pwmclk for the pulse width modulation; and a timing signal Tscan for controlling the operation of the scanning circuit 2.

(Scanning Circuit)

Figure 14:
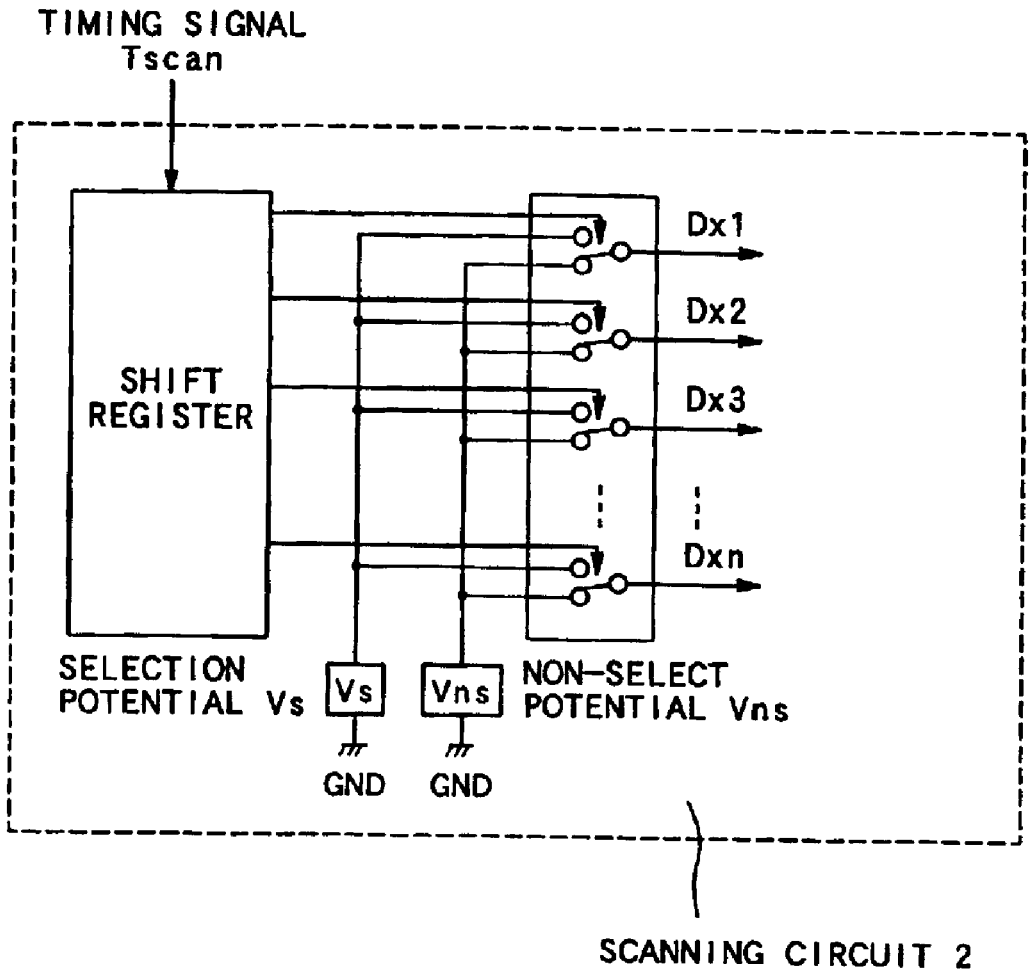
FIG. 14 is a block diagram showing a construction of a scanning circuit of the image display device.

As shown in FIG. 14, the scanning circuits 2 and 2' are the circuits for outputting the select potential Vs or the non-selection potential Vns to the connection terminals Dx1 to DxM to sequentially scan the display panel 1 one line at a time within the horizontal scanning period.

The scanning circuits 2 and 2' are the circuits which sequentially change the scanning wiring that is being selected within one horizontal scanning period at a time, making the changes in synchronization with the timing signal Tscan from the timing generation circuit 4.

Note that the timing signal Tscan is a group of timing signals composed of vertical synchronization signals and horizontal synchronization signals.

The scanning circuits 2 and 2' are each composed of M number of switches and shift resistors as shown in FIG. 14. These switches are preferably composed of transistors and FETs.

Note that, in order to reduce the voltage drop in the scanning wiring the scanning circuits 2 and 2' are preferably connected to both ends of the scanning wirings in the display panel 1 and are driven from both ends.

On the other hand, in accordance with this embodiment, a structure in which the scanning circuits 2 and 2' are not connected to both ends of the scanning wirings is also effective. Formula 6 may be applied in this structure simply by changing the parameters in Equation 6.

(Inverse-γ Processing Unit)

CRTs exhibit a luminous characteristic (hereinafter referred to as a "inverse γ characteristic") that is substantially equivalent to taking the input to the 2.2nd power.

Because of this CRT characteristic, input image signals are generally converted according to a γ characteristic which takes the signal to the 0.45th power, so that a linear luminous characteristic is exhibited upon display on the CRT.

On the other hand, the display panel of the image display device according to this embodiment exhibits the luminous characteristic which is substantially linear with respect to the amount of time that the drive voltage is applied. Therefore, in the case where the modulation is performed by adjusting the duration of time that the drive voltage is applied, the input image signal must be converted (hereinafter referred to as a "inverse γ conversion") in accordance with the inverse-γ characteristic.

The inverse-γ processing unit 17 in FIG. 13 is a block for performing the inverse-γ conversion on the input image signal.

In the inverse-γ processing unit 17 of this embodiment, the above-mentioned inverse-γ conversion processing is achieved with a memory.

Figure 15:
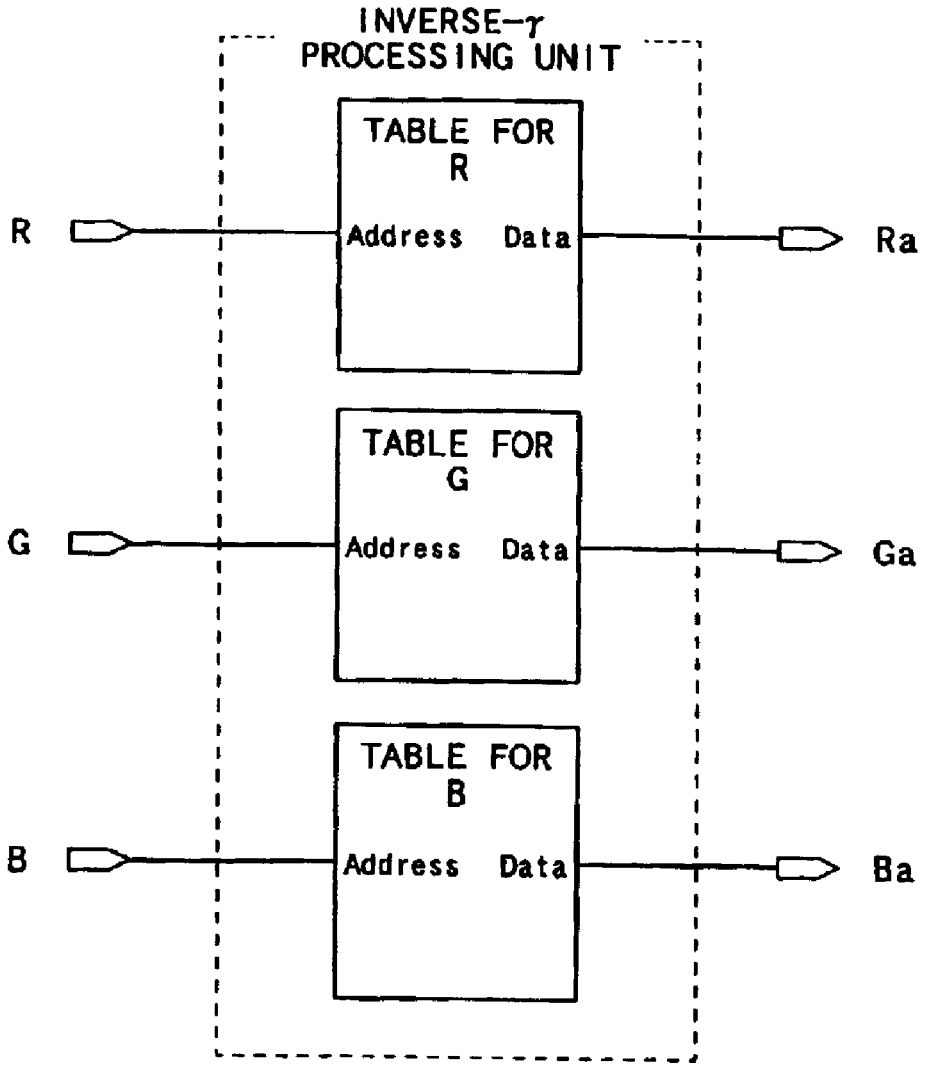
FIG. 15 is a block diagram showing a construction of an inverse-γ processing unit of the image display device.

In the composition of the inverse-γ processing unit 17, the number of bits composing the image signals R, G and B is 8 bits, and the number of bits composing the image signals Ra, Ga and Ba which are outputs from the inverse-γ processing unit is also 8 bits. Also, a memory having 8-bit addresses for storing 8-bit data is used for each of the colors. (FIG. 15).

(Selection Circuit)

Into a selection circuit 1302 are inputted image signals Ra, Ga and Ba which were outputted from the inverse-γ processing unit 17, and image signals Rp, Gp and Bp which were outputted from a pattern generating circuit 1303 to be described below, and the selection circuit 1302 selects either the image signals Ra, Ga and Ba or the image signals Rp, Gp and Bp, and then outputs this as image signals Rb, Gb and Bb. When in an "adjusting mode", the selection circuit 1302 selects the image signals Rp, Gp and Bp, but during normal display it selects the image signals Ra, Ga and Ba to be outputted as the image signals Rb, Gb and Bb.

(Data Array Conversion Unit)

Figure 16:
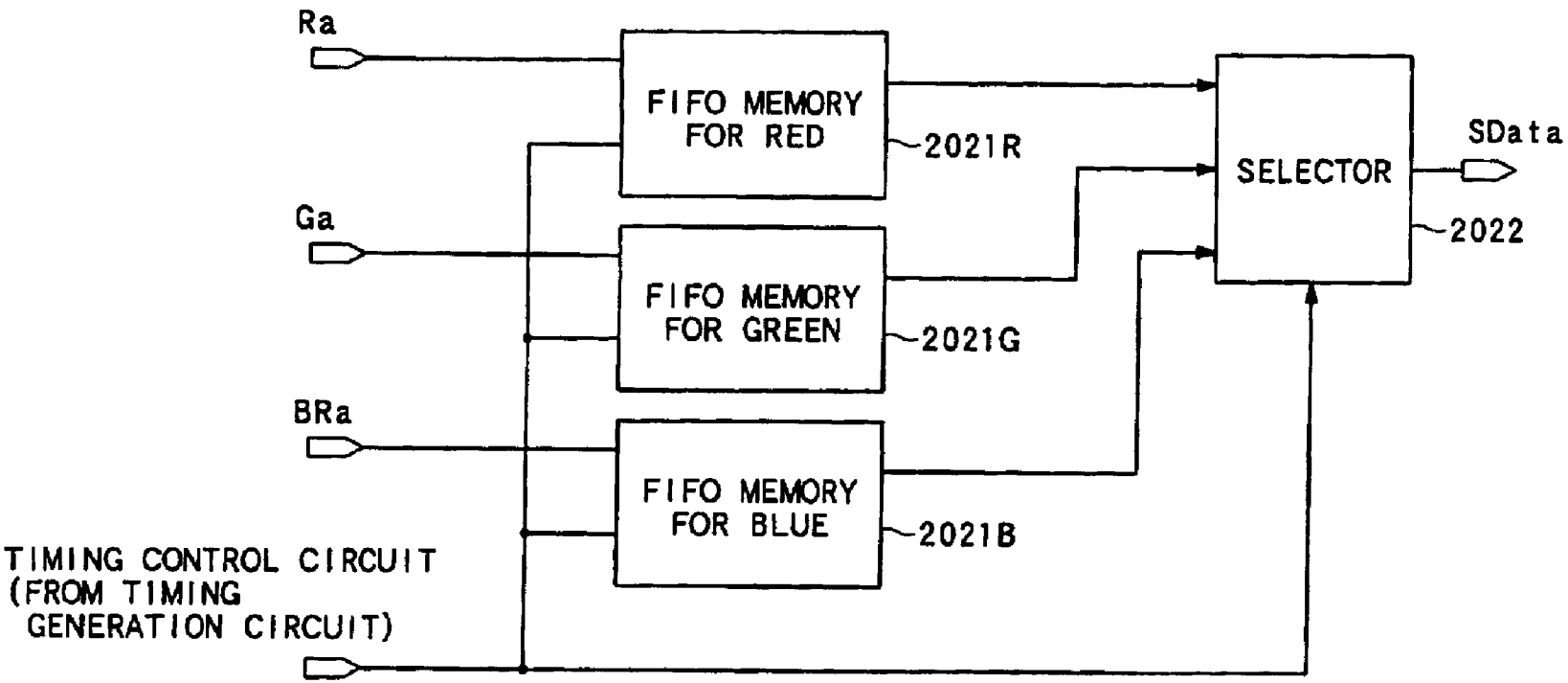
FIG. 16 is a block diagram showing a construction of a data array conversion unit of the image display device.

A data array conversion unit 9 is a circuit for performing a parallel/serial conversion on the RGB parallel image signals Rb, Gb and Bb, to make them appropriate for pixel array of the display panel. As shown in FIG. 16, the data array conversion unit 9 is composed of FIFO (a First In First Out) memories 2021R, 2021G and 2021B for each of the RGB colors, and a selector 2022.

Although they are not shown in FIG. 13, the FIFO memory has two memories capable of holding number of words equal to the number of horizontal pixels, where one of the memories is for odd-number lines, and the other memory is for even-number lines. When image data from an odd-number line is inputted, this data is inputted into the FIFO for the odd-number line while image data stored in the immediately previous horizontal scanning period is read out from the FIFO memory for the even-number line. When the image data from the even-number line is inputted, the data is written into FIFO for the even-number line while the image data stored in the immediately previous horizontal scanning period is read out from the FIFO for the odd-number line.

The data read out from the FIFO memory undergoes the parallel/serial conversion by the selector in accordance with the pixel array of the display panel, and is then outputted as serial image data SData for the RGB. The serial image data SData operates based on the timing control signals from the timing generation circuit 4.

(Delay Circuit 19)

The image data SData which has been reordered by the data array conversion unit 9 is inputted into the compensated data calculation circuit 14 and into the delay circuit 19. A compensated data interpolating section of the compensated data calculation circuit 14 described below cross-references horizontal position information x from the timing control circuit and the value of the image data SData to calculate the compensation data CD which will be suitable for each horizontal position and for each image data.

The delay circuit 19 is provided to absorb the time required for the calculation of the compensation data (i.e., the compensated data interpolation processing described above). When the adder 12 adds the compensation data to the image data, the delay circuit 19 performs the delay so that the compensation data corresponding to the image data is added accurately. The delay circuit 19 is constituted by using a flip-flop circuit.

The adder 12 adds the compensation data CD from the compensated data calculation circuit 14 to the image data Data. By adding these together, the image data Data gets compensated and is sent as the compensated image data Dout to a multiplier.

Note that, the number of bits constituting the compensated image data Dout outputted from the adder 12 is preferably set to a number of bits which will not cause an overflow when the compensation data is added to the image data.

More specifically, assuming that the image data Data has a data width of 8 bits with a maximum value of 255, and assuming the compensation data CD has a data width of 7 bits with a maximum value of 120, then the maximum value that can result from the addition is 255+120=375. However, the compensated image data Dout outputted from the adder 12 preferably has an output bit width of 9 bits so that the overflow does not occur when the adding takes place.

(Overflow Processing)

Description has already been made regarding how the calculated compensation data CD is added to the image data Data to achieve the compensation in accordance with this embodiment.

Now, assuming the number of bits processed by the modulation circuit 8 is 8 bits, and the compensated image data Dout outputted form the adder 12 is composed of 9 bits, if the compensated image data Dout is simply inputted into the modulation circuit 8 as it is, the overflow will occur.

Further, the compensation data CD has a tendency to get larger the greater the per-frame average brightness of the image data inputted into the image display device of the present invention. Inversely, the compensation data CD tends to have a smaller value as the per-frame brightness decreases.

Therefore, in order to prevent the overflow, a limiter 1301 is provided in the image display device according to this embodiment. When a compensated image data Dout having a value which is greater than the maximum value that the modulation circuit 8 can accept is inputted into the limiter 1301, the limiter 1301 outputs the maximum value. When compensated image data Dout having a value which is less than the maximum value that the modulation circuit 8 can accept is inputted into the limiter 1301, the limiter 1301 outputs the data just as it is.

Compensated image data Dlim is the compensation data which has been completely limited by the limiter 1301 down to the input range of the modulation circuit 8, and this is provided via the shift register 5 and the latch 6 to the modulation circuit 8.

Further, as another construction for preventing the overflow, before the compensation data is to be added to the image data, the image data may be multiplied in advance by a gain ranging from 0 to 1 depending on the size of the compensation data that will be added, to reduce the range that the image data may take.

In a construction such as the one described above, the compensation data is calculated based on the size that the image data will have after the gain has been multiplied and then the adder 12 adds the compensation data to the image data, whereby the overflow is prevented.

Further, in yet another construction, the gain may be determined in advance so that the maximum value that could be produced by after adding the compensation data to the image data at the adder 12 will fall within the input range of the modulation means.

Further, it is also possible to provide means for detecting the maximum value that will be produced in each frame by adding the compensation data to the image data, and determining the gain such that this maximum value will fall within the input range of the modulation means.

Note that the "gain" described here is the gain for preventing the overflow, and it is a different "gain" from a gain that will appear below when explaining an adjustment made to the strength of the compensation.

(Shift Resistor, Latch Circuit)

The compensated image data Dlim undergoes the serial/parallel conversion by the shift resistor 5, whereby the compensated image data Dlim changes from its serial data format into parallel image data ID1 to IDN per modulation wiring and then it is outputted to the latch 6. The latch 6 latches the data from the shift resistor 5 immediately before one horizontal interval is started, based on the timing signal Dataload. The outputs from the latch 6 are delivered to the modulation circuit 8 as parallel image data D1 to DN.

Note that, in accordance with this embodiment, the image data ID1 to IDN and D1 to DN are each composed of 8 bits. Their operation timing is based on the timing control signals TSFT and Dataload from the timing generation circuit 4.

(Details of the Modulation Circuit)

The parallel image data D1 to DN outputted from the latch 6 is provided to the modulation circuit 8.

Figure 17A:
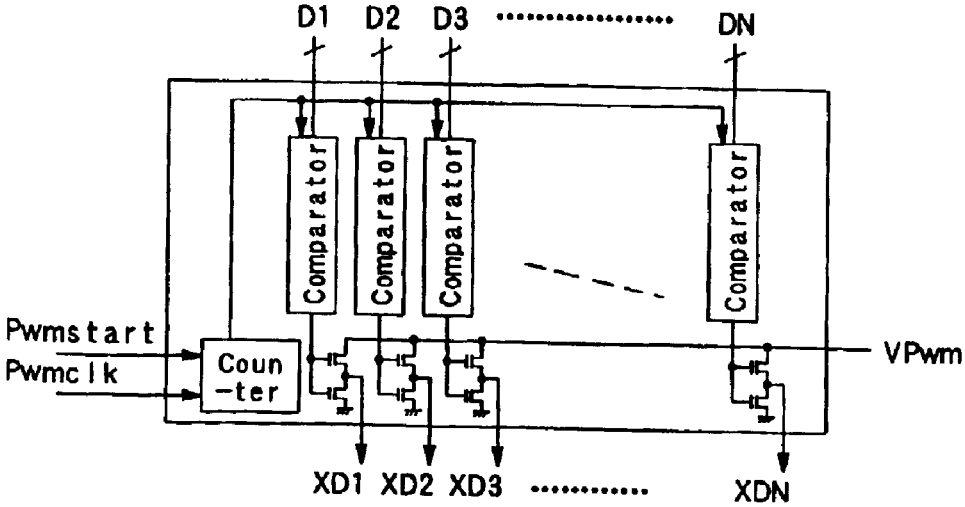
FIGS. 17A, 17B, and 17C are diagrams for explaining construction and operations of a modulation circuit of the image display device.

As shown in FIG. 17A, the modulation circuit 8 is a pulse width modulation circuit (PWM circuit) including a PWM counter, and a comparator and a switch (a FET in FIG. 17A) for each modulation wire.

Figure 17B:
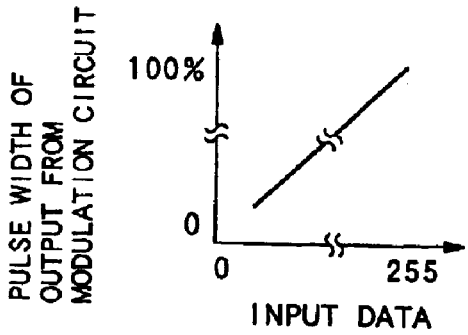

As shown in FIG. 17B, the relationship between the image data D1 to DN and the output pulse width from the modulation circuit 8 is a linear relationship.

Figure 17C:
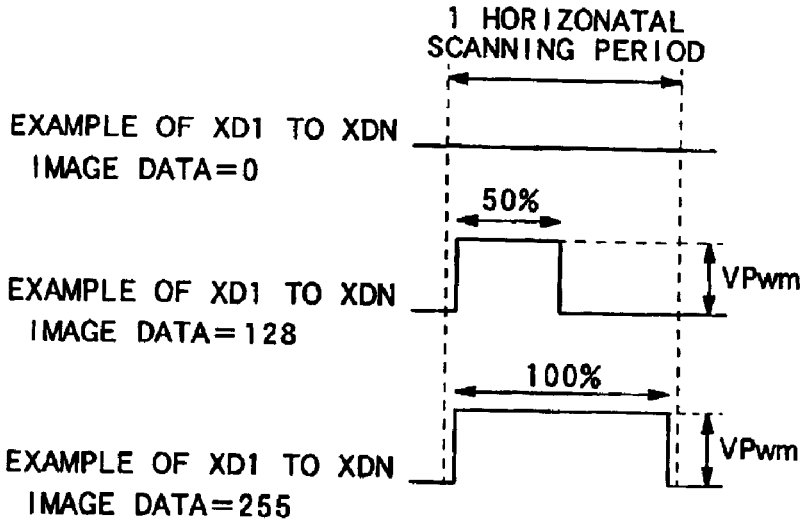

FIG. 17C shows 3 examples of an output waveform from the modulation circuit 8.

In FIG. 17C, the waveform depicted at the top is a waveform when the input data to the modulation circuit 8 is 0. The waveform depicted in the middle is a waveform when the input data to the modulation circuit 8 is 128. The waveform depicted on the bottom is the waveform when the input data to the modulation circuit 8 is 255.

Note that, in accordance with this embodiment, the limiter 1301 limits the number of bits of the data D1 to DN being inputted into the modulation circuit 8 to 8 bits.

Note that, in the above description, it was written that when the input data to the modulation circuit 8 is 255, the modulation signal having a pulse width equivalent to one horizontal scanning period is outputted. However, as shown in detail in FIG. 17C, an extremely short periods where the pulse modulation is not driven are provided before the rising edge of the pulse and after its falling edge, to provide some leeway in the timing.

Figure 18:
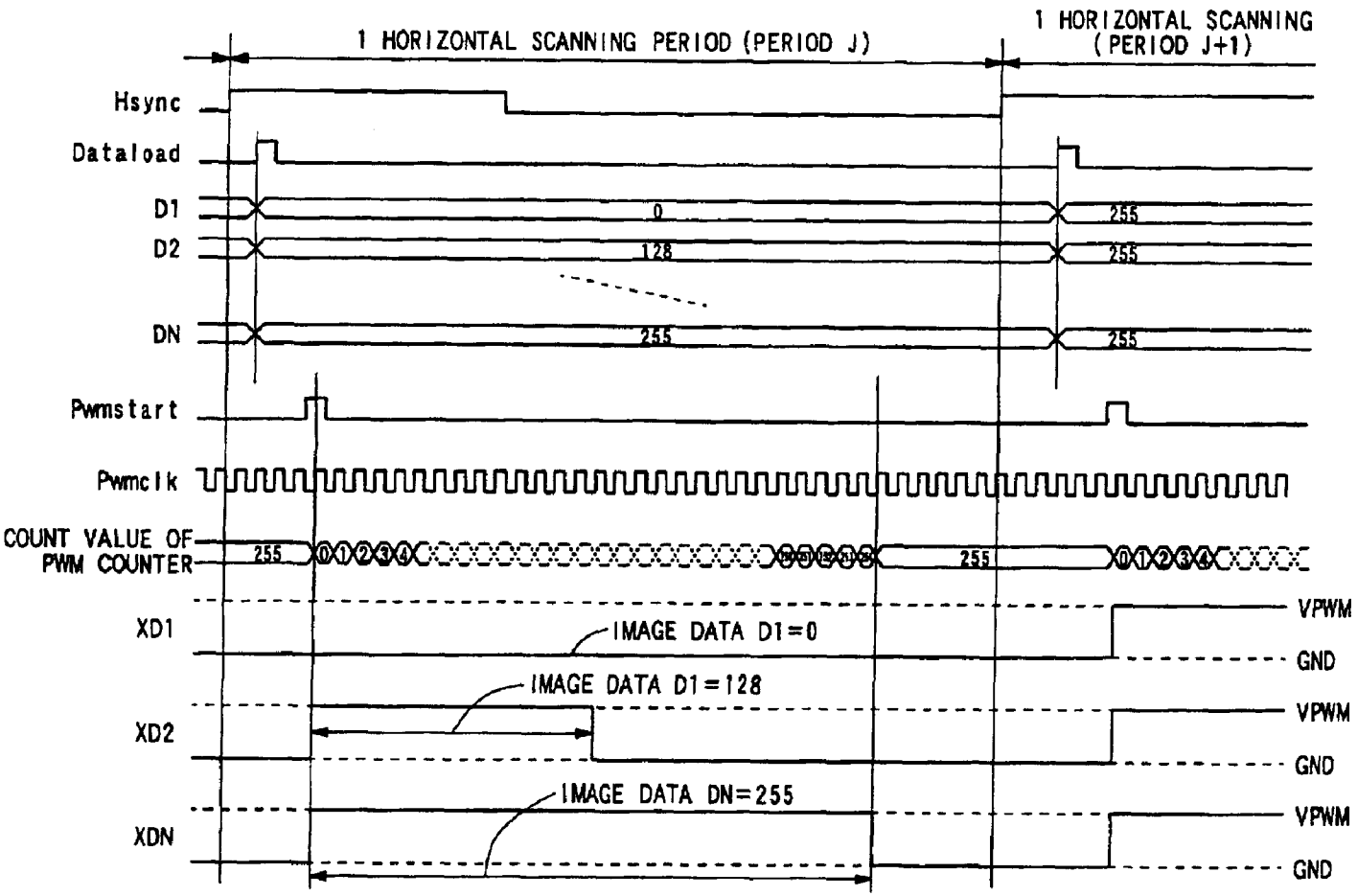
FIG. 18 is a timing chart for modulation means of the image display device.

FIG. 18 is a timing chart showing the operation of the modulation circuit 8 according to the present invention.

In FIG. 18, Hsync denotes a horizontal synchronization signal; Dataload denotes a load signal provided to the latch 6; D1 to DN denote the input signals to columns 1 to N of the modulation circuit 8 described above; Pwmstart denotes a synchronization clear signal for the PWM counter; and Pwmclk denotes a clock of the PWM counter. Further, XD1 to XDN represent outputs of the modulation circuit 8 pertaining to columns 1 to N.

As shown in FIG. 18, when one horizontal scanning period starts, the latch 6 latches the image data and transfers the data to the modulation circuit 8.

As shown in FIG. 18, the PWM counter starts the count based on the Pwmstart and the Pwmclk, and when the count value reaches 255, it stops the counter and holds the value 255.

The comparator provided to each of the columns compares the counter value of the PWM counter and the image data from each of the columns. When the value of the PWM counter is greater than the image data, it outputs "High", and it outputs "Low" during all the other periods.

The comparator output is connected to the gate of the switch at each column. While the comparator output is "Low", the switch on a VPWM side shown in FIG. 18 is turned "ON", and the switch on a GND side is turned "OFF", so that the modulation wiring connects to the voltage VPWM.

In contrast, while the comparator output is "High", the switch on the VPWM side in FIG. 18 is turned "OFF", and the switch on the GND side is turned "ON", so that the voltage in the modulation wirings connects with the ground potential.

Each part operates as described above, whereby the pulse-width modulation signal outputted by the modulation circuit 8 exhibits the waveform with the synchronized rising edge of the pulse as shown in D1, D2 and DN in FIG. 18.

(Compensation Data Calculation Circuit)

Figure 19:
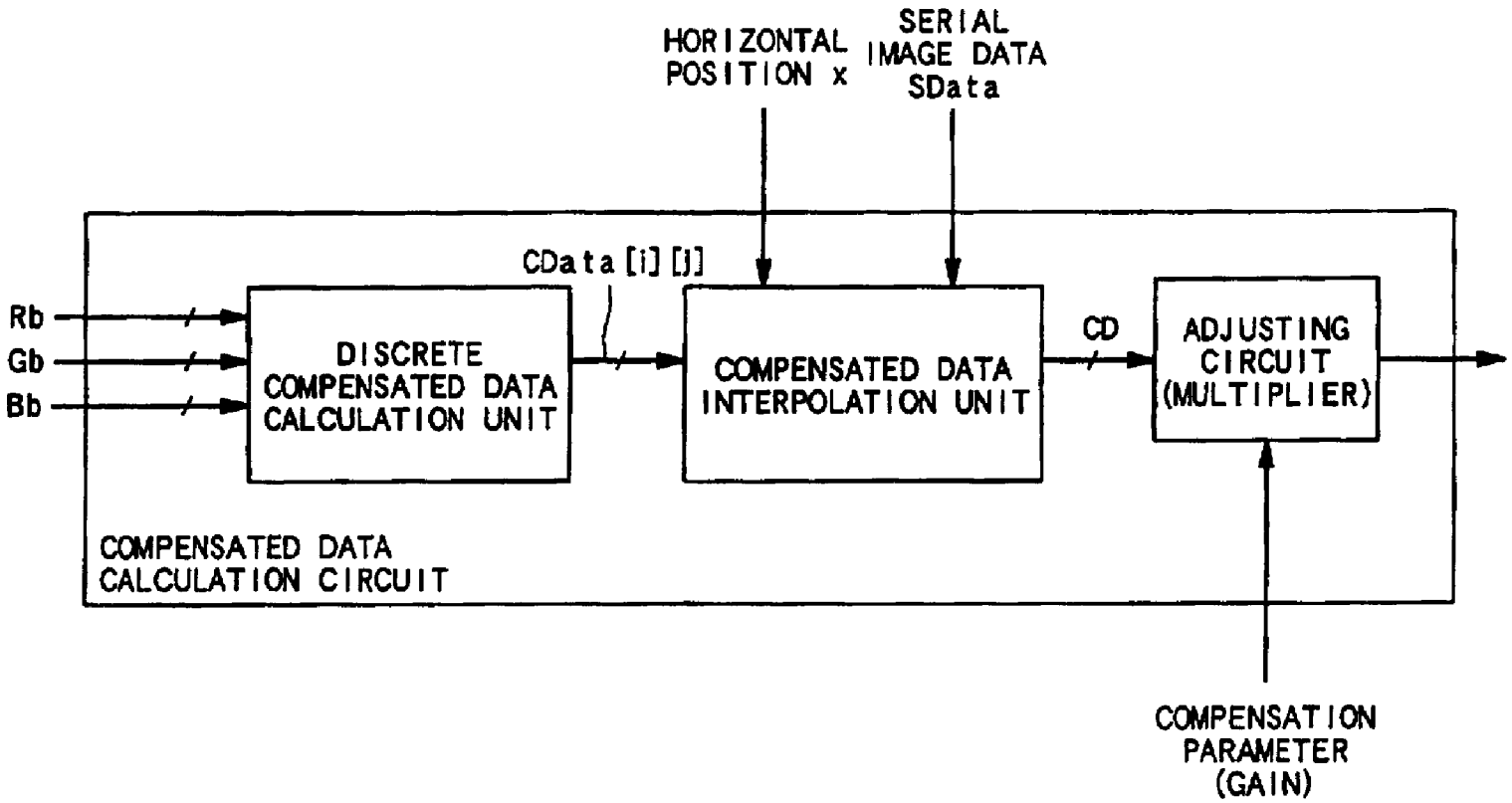
FIG. 19 is a block diagram showing a construction of a compensated image data calculation circuit of the image display device.

The compensation data calculation circuit 14 calculates the compensation data of voltage drop according to the compensation data calculation method described above. As shown in FIG. 19, the compensation data calculation circuit 14 is composed of 3 blocks, including a discrete compensation data calculation unit, a compensation data interpolation unit, and an adjusting circuit for adjusting the compensation data.

The discrete compensation data calculation unit calculates the voltage drop amount based on the inputted image signal, and discretely calculates the compensation data based on the voltage drop amount. In order to reduce the volume of the calculations and the amount of hardware, the discrete compensation data calculation unit discretely calculates the compensation data using the concept of the degeneracy model discussed above.

The compensation data interpolation unit interpolates based on the compensation data that has been discretely calculated, and calculates the compensation data CD that is appropriate for the size and the horizontal display position x of the serial image data SData.

The adjusting circuit (i.e., the multiplier) multiplies the compensation data CD by a gain (coefficient) having any value between 0 and 1, which are compensation parameters out putted by the controller 1304.

(The Discrete Compensation Data Calculation Unit)

FIG. 20 is a discrete compensation data calculation unit for discretely calculating the compensation data according to the present invention.

The discrete compensation data calculation unit divides the image data into blocks, and calculates a statistical amount (i.e., a number of illuminations) per block. The discrete compensation data calculation unit has a function for calculating the time change of the voltage drop amount at each of the node positions from the statistical amount; a function for converting the voltage drop amount at each time into an amount of luminous brightness; a function for integrating the amount of luminous brightness along a time direction to calculate a total amount of luminous brightness; and a function for calculating compensation data with respect to the image data reference values at discrete reference points.

The discrete compensation data calculation unit shown in FIG. 20 is schematically composed of a number of illuminations counting means 100*a* to 100*d*; register groups 101*a* to 101*d* for storing the number of illuminations at each time point and per block; a CPU 102; a table memory 103 for storing the parameters aij described in Equation 3 and Equation 6; a temporary register 104 for temporarily storing calculation results; a program memory 105 in which a program(s) for the CPU are stored; a table memory 110 in which a conversion data for converting the voltage drop amounts into emitted current amounts is written; and a register group 106 for storing the results of the calculations for the discrete compensation data described above.

Figures 20A, 20B:
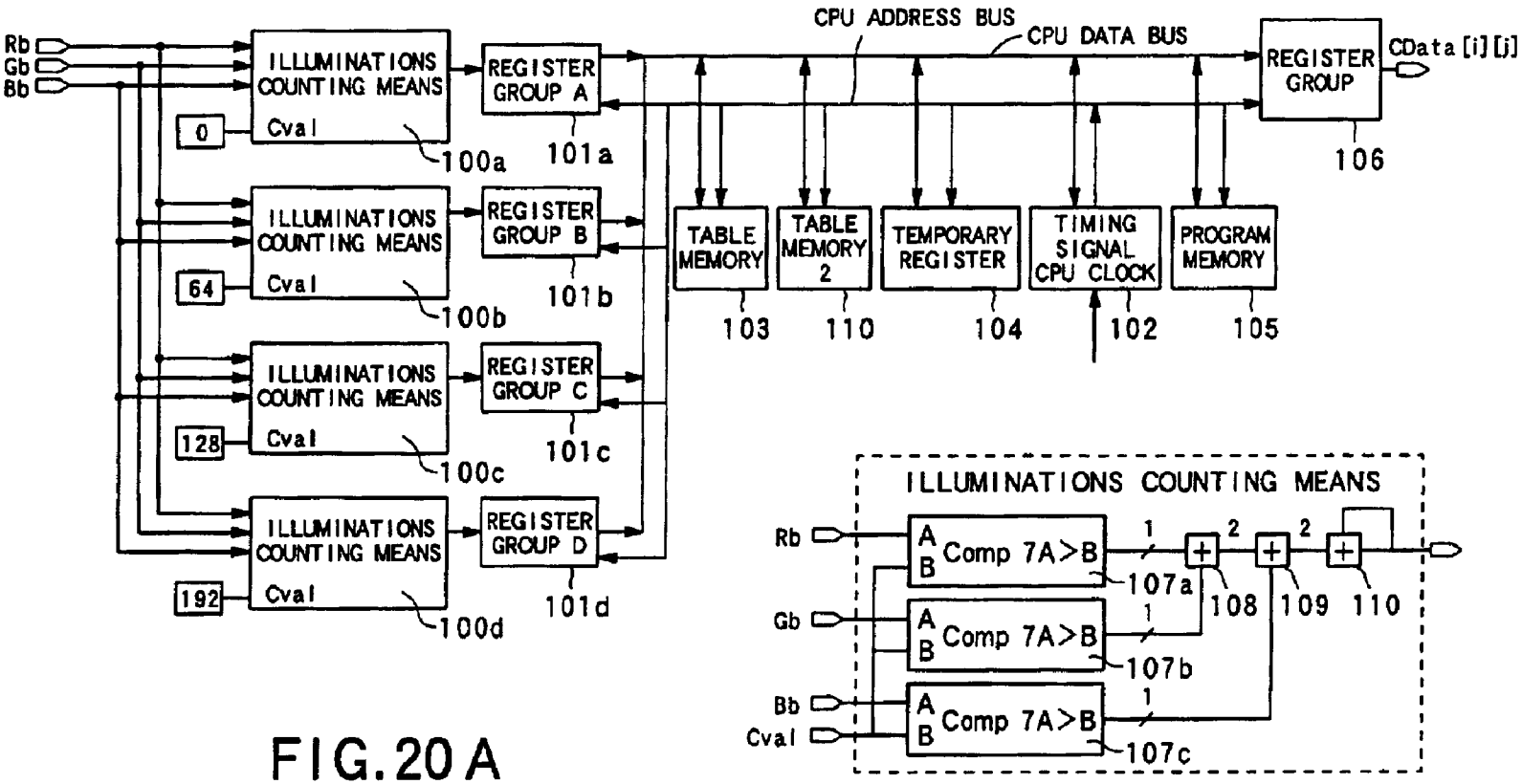
FIGS. 20A and 20B are block diagrams of a construction of a discrete compensation data calculation unit of the image display device.

The number of illuminations counting means 100*a* to 100*d* are composed of comparators 107*a* to 107*c* and adders 108, 109 and 110 and the like as drawn in FIG. 20B. The image signals Rb, Gb and Bb are inputted into the comparators 107*a* to 107*c*, respectively, and are compared one after the other with the value of Cval. Note that "Cval" corresponds to the above-mentioned image data reference value set with respect to the image data.

The comparators 107*a* to 107*c* compare the image data with Cval, and if the image data is greater, then they output "High", and if the image data is lower they output "Low".

The outputs from the comparators are added to each other by means of the adders 108 and 109, and then the adder 110 adds them together by blocks. The results from adding these up by blocks are stored in the register groups 101*a* to 101*d* as the number of illuminations per block.

0, 64, 128 and 192 are inputted into the number of illuminations counting means 100*a* to 100*d*, respectively, as the comparator comparison value Cval.

As a result, the number of illuminations counting means 100*a* counts the number of image data that are greater than 0 and stores the total per block into the register group 101*a*.

Similarly, the number of illuminations counting means 100*a* counts the number of image data that are greater than 64 and stores the total per block into the register group 101*b*.

Similarly, the number of illuminations counting means 100*c* counts the number of image data that are greater than 128 and stores the total per block into the register group 101*c*.

Similarly, the number of illuminations counting means 100*d* counts the number of image data that are greater than 192 and stores the total per block into the register group 101*d*.

When the number of illuminations is counted per block and per time, the CPU 102 reads out the parameter table aij stored in the table memory 103 as needed. Then, the CPU 102 calculates the voltage drop amount based on Equations 3 to 8, and stores the calculation results in the temporary register 104.

In accordance with this embodiment, the CPU 102 has a cumulative sum calculating function for performing Equation 3 calculation smoothly.

As means for achieving the calculation given in Equation 3, the CPU 102 does not have to perform the cumulative sum calculation. Instead, for example, the calculation results may be put into the memory.

That is, the number of illuminations per block can be inputted, and then the voltage drop amounts at each node position with respect to all the imaginable input patterns can be stored in the memory.

When the calculation of the voltage drop amounts finishes, the CPU 102 reads out the voltage drop amounts for each block and for each time point from the temporary register 104, and then it cross-references the table memory 2 (110) to convert the voltage drop amounts into emitted charge amounts, and then calculates the discrete compensation data according to Equations 9 to 21.

The calculated discrete compensation data is then stored into the register group 106.

(Compensation Data Interpolation Unit)

The compensation data interpolation unit calculates the compensation data so that it is appropriate for the position (i.e., horizontal position) where the image data will be displayed and the size of the image data. By interpolating from the discretely calculated compensation data, the compensation data interpolation unit calculates the compensation data according to the display position (i.e., horizontal position) of the image data and the size of the image data.

Figure 21:
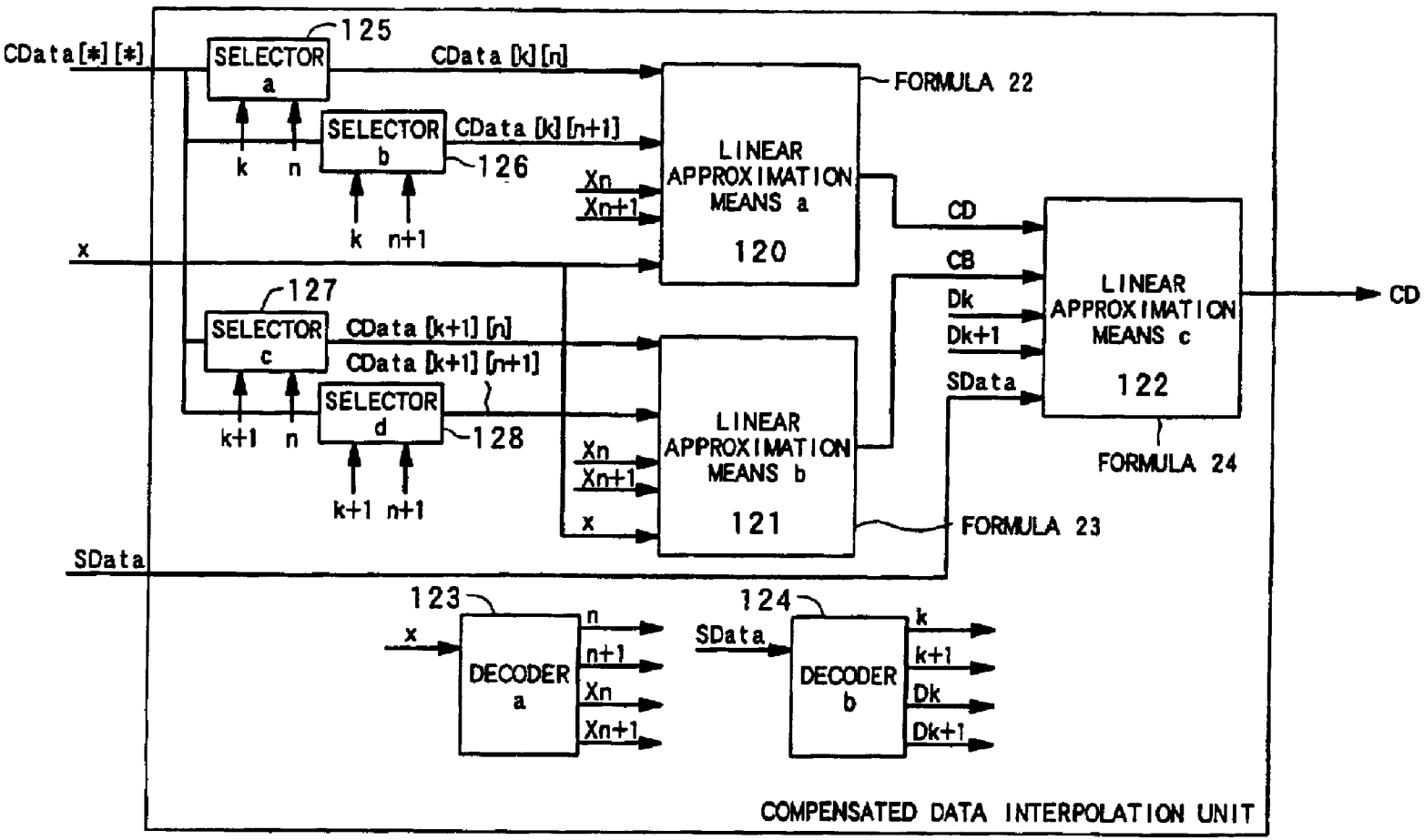
FIG. 21 is a block diagram of a construction of a compensation data interpolation unit.

FIG. 21 is a diagram for explaining the compensation data interpolation unit.

In FIG. 21, a decoder 123 determines the node numbers n and n+1 of the discrete compensation data to be used for the interpolation, based on an image data display position (i.e., horizontal position) x. Based on the size of the image data, a decoder 124 determines k and k+1 to be used in Equations 2 to 24.

Further, selectors 125 to 128 select the discrete compensation data and provide this to linear approximating means.

Further, linear approximating means 121 to 123 perform the linear approximations according to the Equations 22 to 24, respectively.

Figure 22:
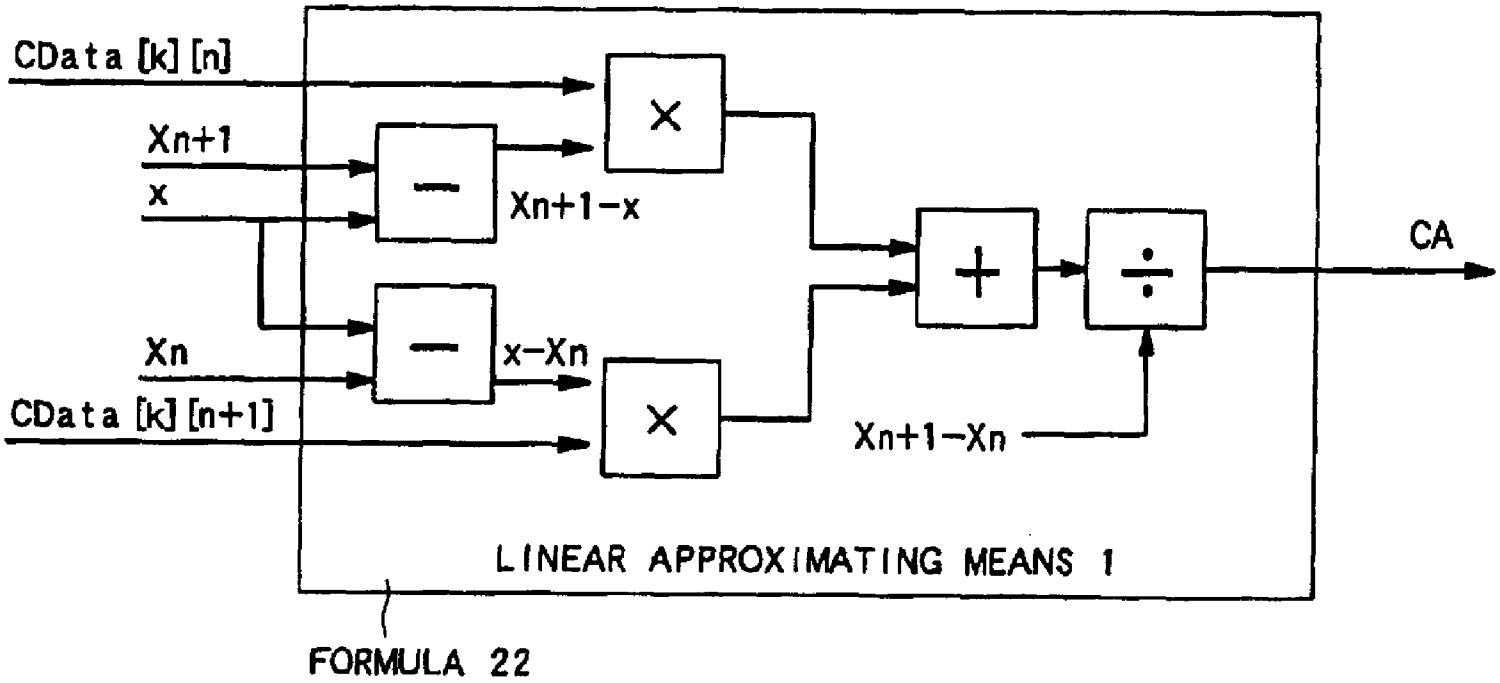
FIG. 22 is a block diagram of a construction of linear approximation means.

FIG. 22 shows an example of a construction of the linear approximating means 121. Generally, as is shown in the operators in Equations 22 to 24, the linear approximating means can be composed of a subtracter, a multiplier, an adder, a divider and the like.

However, it is preferable that the linear approximating means is constructed such that the number of column wirings between the nodes where the discrete compensation data is calculated and the intervals between the image data reference values where the discrete compensation data is calculated (i.e., the time intervals during which the voltage drops are calculated) will equal a power of 2, which enables the hardware to be constructed extremely simply. If the number of column wirings and intervals between the image data reference values are set to powers of 2, then $X_{n+1}-X_n$ at divider shown in FIG. 22 becomes a power of 2, and thus it is only necessary to perform a bit shift.

If the value of $X_{n+1}-X_n$ is always a given value and this value is a value represented by a power of 2, then the result from the adding performed by the adder can be shifted by an amount equivalent to the power that was multiplied, and then this shifted result can be outputted. It is not necessary to furnish the divider.

Further, setting the intervals between the nodes at other places where the discrete compensation data is to be calculated and the intervals between the image data reference values to a power of 2 provide extremely many advantages. For example, it becomes possible to make the decoders 123 to 124 in a simple fashion, and the calculation performed by the subtracter in FIG. 22 can be replaced with the simple bit calculation.

(Operation Timing of the Units)

Figure 23:
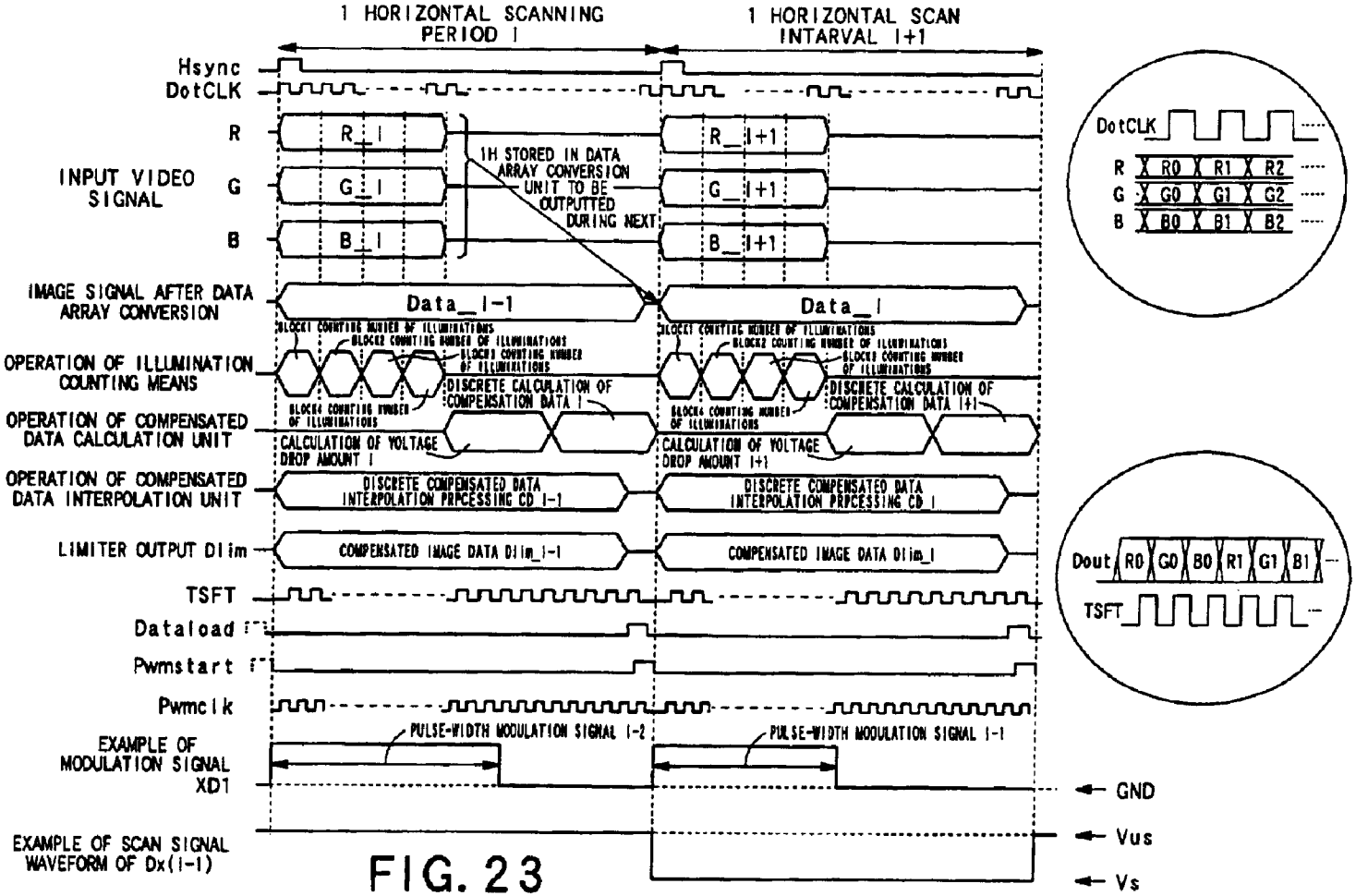
FIG. 23 is a timing chart for an image display device.

FIG. 23 shows a timing chart of operational timing of the units.

Note that, in FIG. 23, Hsync is the horizontal synchronization signal; DotCLK is a clock made from the horizontal synchronization signal Hsync by a PLL circuit inside the timing generation circuit; R, G, B are digital image data from an input switching circuit; Data is image data which has already undergone data array conversion; Dlim is the output from the limiter circuit, and is the compensated image data which has undergone the voltage drop compensation and has also been adjusted according to the selected compensation conditions; TSFT is the shift clock for sending the compensated image data Dlim to the shift register 5; Dataload is a load pulse for latching the data to the latch 6; Pwmstart is a start signal for the above-mentioned pulse width modulation; and a modulation signal XD1 is one example of the pulse width modulation signal provided to the modulation wiring 1.

When one horizontal interval is started, the digital image data RGB is forwarded from the input switching circuit. In FIG. 23, image data inputted at a horizontal scanning period I are indicated by R_I, G_I and B_I. The image data R_I, G_I and B_I are accumulated in the data array conversion unit 9 during the one horizontal interval. Then, during a horizontal scanning period I+1, the image data R_I, G_I and B_I are outputted as digital image data Data_I in correspondence with the arrangement of the pixels in the display panel 1.

The image data R_I, G_I and B_I is inputted into the compensation data calculation circuit 14 during the horizontal scanning period I. The compensation data calculation circuit 14 counts the number of illuminations as described above, and when it finishes counting it calculates the voltage drop amount.

After the voltage drop amount is calculated, the discrete compensation data is calculated and the results of the calculation are stored in the register.

During the horizontal scanning period I+1, the compensation data calculation circuit 14 interpolates from the discrete compensation data in synchronization with the image data Data_I before the one horizontal scanning period being outputted from the data array conversion unit 9, and thus the compensation data is calculated. The compensated compensation data is multiplied by the gain that was selected by the adjusting circuit, and then the result is provided to the adder 12.

At the adder 12, the image data Data and the compensation data CD are added together one after the other, and then the compensated image data Dlim is forwarded to the shift register 5. The shift register 5 stores the compensated image data Dlim for one horizontal interval in accordance with TSFT, and also performs the serial/parallel conversion and outputs the parallel image data ID1 to IDN to the latch 6. The latch 6 latches the parallel image data ID1 to IDN from the shift register 5 in correspondence with the rising edge of the Dataload signal, and then transfers the latched image data D1 to DN to the pulse width modulation circuit 8.

The pulse width modulation circuit 8 outputs the pulse-width modulation signal having a pulse-width which corresponds to the latched image data. In accordance with the image display device of the present embodiment, the pulse width outputted by the modulation circuit 8 is, as a result, displayed after 2 horizontal scanning periods subsequent to the inputted image data.

By performing the image display with the image display device described above, it becomes possible to compensate for the voltage drop amounts in the scanning wirings, which was a problem up to now. Further, it becomes possible to improve the deterioration of the displayed image which resulted from the voltage drops. Thus, an extremely satisfactory image can be displayed.

Further, the compensation data is calculated discretely and the compensation data for places between the discretely calculated points is obtained by interpolating. As a result, extremely superior effects can be obtained. For example, the image display device can calculate the compensation data extremely simply, and the image display device can be realized with extremely simple hardware.

(Other Examples of Applications of the Compensation Data Calculation Circuit)

The foregoing description introduced the case where the compensation data calculation circuit 14 calculated the compensation data based on the RGB parallel image data. However, restriction is not made to this case.

For example, it goes without saying that the compensation data can also be obtained using the image data that has been converted from the RGB parallel data to the RGB serial data by the data array conversion unit 9.

In this case, in order to secure the necessary time to calculate the compensation data, it is necessary to have a register or a memory for delaying the RGB serial image data, but it goes without saying that the same compensation can be performed in this case as well.

It goes without saying that this construction provides an effect of reducing the line memory that was necessary for performing the data array conversion (i.e., the parallel/serial conversion) on the image data, and also reducing the amount of hardware by constructively using the delay time caused by the data conversion to calculate the compensation data during the delay time, and also by performing the compensation on the serial image data.

As described above, in accordance with the image display device constructed as described above, it becomes possible to favorably ameliorate the deterioration of the display image caused by the voltage drops in the scanning wirings, which was a problem up to now.

Further, by introducing some approximations, extremely superior effects are provided. For example, it becomes possible to simply and favorably calculate the compensation amount for the image data, and it becomes possible to realize the image display device with extremely simple hardware.

Hereinafter, explanation will be made regarding selection of compensation conditions and compensation adjustments which are unique to the present invention.

In the display panel according to the present invention, the influence from the voltage drops caused by the resistance in the scanning wirings causes the deterioration of the displayed image to occur, as described above.

Since this voltage-drop phenomenon varies due to factors such as slight fluctuation (i.e., individual differences) in the resistance values in the scanning wirings of the display panel 1 and due to fluctuation (i.e., individual differences) in the characteristics of the display elements, it was preferable to have an adjustment mode which the user could adjust easily in order to obtain the optimal compensation effect.

Further, when the image display elements used in the display panel of the present invention are driven for an extremely long time, a phenomenon occurs in which the element currents diminish very subtly.

Even in the case of the reduction in the element current as described above, the adjustment mode of the present invention as described below can be used to obtain a preferable compensation effect by the user easily selecting the compensation conditions.

Therefore, this embodiment is provided with means for multiplying the compensation data by the gain and the gain to be amplified by this compensation data is adjusted, to thereby adjust the strength of the compensation.

In accordance with this embodiment, a pattern generator outputs given image data for performing the adjustment.

Specifically, the person performing the adjustment uses a remote controller to give an instruction to enter the adjustment mode.

When a remote controlled light-receiving section 1305 receives the signal from the remote controller, a controller 1304 switches the selector 1302 in response to the instruction, so that the selector 1302 outputs the output from the pattern generator 1303, not the output from the inverse γ processing unit 17, as the image signals Rb, Gb and Bb.

Simultaneously, the compensation conditions used by the compensated data calculation circuit 14 (i.e., the gain used by the adjusting circuit in the compensated image data calculation circuit) is set to its original value. Here, the initial value is assumed to be a gain of 0.

For the given image data that the adjustment, it is possible to select image data which will make the state of the compensation easy to understand. Here, as shown in FIG. 24, the image data for adjusting includes a clear vertical line (i.e., a perpendicular line, which is parallel to the modulation signal (column) wirings), and a clear sideways line (a horizontal line, which is parallel to the scan (line) wirings).

Figure 24:
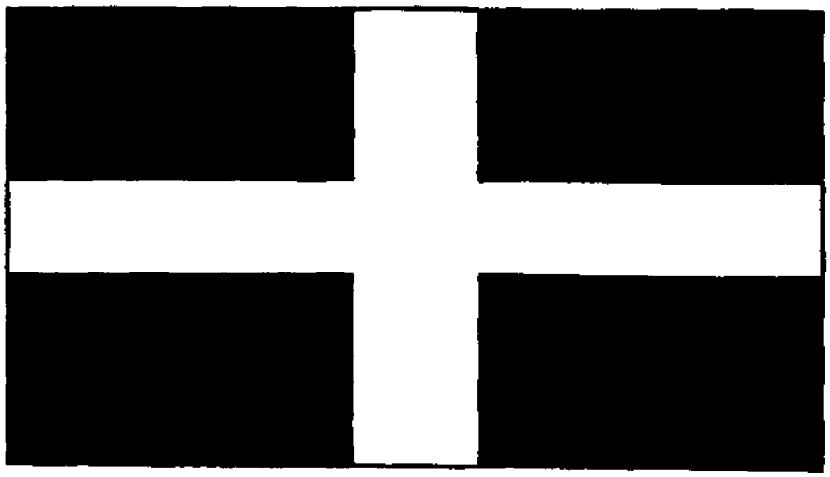
FIG. 24 is a diagram showing one example of given image data serving as a basis for adjustment data.

Note that FIG. 24 simply visualizes the size of the brightness signal for the given image data. FIG. 24 does not show what is actually displayed. The cross-shaped pattern was used here, but restriction is not made to this pattern. For example, a pattern in which a black square shape with a predetermined size is displayed on a screen having a white background may also be favorably used. A construction may be favorably adopted in which the above-mentioned pattern is displayed and the person making the adjustment can compare the brightness levels of white parts of the screen that surrounds the black square-shaped pattern so that he/she can easily judge how much of a compensation is necessary.

Given image data used for making the adjustment should preferably satisfy the following conditions:

(1) The given image data for adjusting must produce regions for comparing the brightness levels, including a first region and a fourth region which extend adjacent to a vertical direction of the screen (perpendicular to the direction along which the scan lines extend, i.e., "Y direction"), each region having a specific width (i.e., a specific length along the direction along which the scan lines extend, i.e., "X direction") and being located at specific positions along the direction of the scan lines.

Here, the first region and the fourth region are created with substantially the same image data.

The image data which constitute the first region and the fourth region are each set at 50% or more of the maximum gradation value.

Note that, when the space between the first region and the fourth region becomes too great, it is difficult to compare them. Therefore, the first region and the fourth region should be adjacent to each other.

Here, "adjacent to each other" means that they are adjoining or that the distance between them is 10 scan lines or less.

Further, for the comparison it is particularly preferable that the image data constituting the first region and the image data constituting the fourth region are identical to each other, but they do not have to be completely identical so long as there is less than a 5% difference between their gradation values.

Note that, in order to perform the comparison, the first region and the fourth region need to have a certain degree of brightness. Therefore, the image data constituting the first region and the fourth region should each have a gradation value that is 50% or more of the maximum gradation value, and it is particularly preferable that they are 70% or more.

Further, given image data for adjusting should be set such that the above-mentioned specific width includes at least 10 adjacent pixels on the scan line.

Further, the first region should favorably include a plural number of scan lines. In particular, 5 lines or more is preferable, and 10 lines or more is even more preferable.

Further, the fourth region should favorably include a plural number of scan lines. In particular, 5 lines or more is preferable, and 10 lines or more is even more preferable.

Further, since it is difficult to observe the influence of the voltage drops at locations near the voltage drop reference positions (.i.e., near the power supply end(s)), the fourth region should be located at a position that is sufficiently distant from the end from which power is supplied to the scan lines. Specifically, the given image data for adjusting should be desirably such that the fourth region is created at a position that is removed from the power supply end(s) by a distance of at least 30% of the length of the screen along the direction of the scan lines. In particular, in a construction in which the power is supplied from both ends of the scan lines, it is desirable that the given image data for adjusting is such that the fourth region is near the center of the scan lines; and in a construction in which the power is supplied from one end of each scan line, the given image data for adjusting is desirably such that the fourth region can be ranging from the central vicinity of the scan lines to a region closer to the end from which the power is not supplied.

(2) The given image data for adjusting must include image data respectively corresponding to a third region which shares scan line(s) with the fourth region and is comprised of region(s) on the screen other than the fourth region, and to a second region which shares scan line(s) with the first region and is at the same position along the direction of the scan lines as the third region.

Here, the given image data for adjusting is configured such that the second region will be a region where a sufficient voltage drop is allowed to occur in the scan line(s) shared with the first region, and such that the third region will be a region where the voltage drop on the scan lines shared with the fourth region is suppressed relative to the voltage drop in the second region.

For example, the number of elements that are simultaneously put into the drive state in the second region by the given image data for adjusting should be greater than the number of elements that are simultaneously put into the drive state in the third region by the adjusted image data.

Here, in order to facilitate evaluation of the influence created by the voltage drop, the given image data for adjusting should include data which simultaneously puts into the drive state at least 55% of all the elements on one scan line in the first region (and one line in the second region), and more preferably at least 70% of the elements (including the elements constituting the first region).

Further, with respect to the third region (and the fourth region), the given image data for adjusting should simultaneously put into the drive state no more than 50% of all the elements on one scan line (this includes the elements constituting the fourth region).

Given image data for adjusting satisfying the above-mentioned conditions is used to perform a display, and then the brightness levels of the first and the fourth regions are compared, whereby the degree of influence being exerted by the voltage drop can be grasped easily.

Note that, in the cross pattern shown in FIG. 24, the region where the vertical bright line and the horizontal bright line intersect corresponds to the first region, and the portions of the horizontal bright line excluding the vertical bright line portion correspond to the second region.

The portion of the vertical bright line above the portion intersecting with the horizontal bright line or the portion below the intersection portion or the portions above and below the intersecting portion may be defined as the fourth region. The black background portion (i.e., the regions in the black background portion that are located along the horizontal direction along the fourth region) corresponds to the third region.

In FIG. 24, in each bright portion, the elements that comprise each bright portion are being driven at the maximum gradation value.

Further, in the above-mentioned example with the black square-shaped pattern (the square-shaped dark portion) on the white background, the fourth region is all or a arbitrarily determined portion of the area(s) other than the black square-shaped region and shares scan lines with the black square-shaped region.

Specifically, the fourth region enables easy recognition of the extent of the influence from the voltage drop when looking at the central vicinity of the screen. The third region is an area other than the fourth region including at least the black square-shaped pattern and extends along the horizontal direction of the fourth region.

The first region may be defined as the region above or the region below the fourth region, or as both the regions above and below the fourth region; and the second region is the region(s) other than the first, the second and the fourth regions.

The person making the adjustment looks at an image displayed according to the initial compensation conditions, and when he/she judges that these conditions are satisfactory, he/she uses the remote controller to give an instruction to end the adjustment mode. Thereafter, the adjusting circuit in the compensated data calculation circuit 14 uses the gain of 0 as the compensation condition. Then, the selector 1302 is switched back to output the output from the inverse γ processing unit 17. Thereafter, the display is performed based on compensated image data that is compensated under these compensation conditions. (However, since the gain is 0 in this case, no actual compensation is performed.)

When the person making the adjustment looks at the image displayed under the initial compensation conditions and judges that the compensation is insufficient, he/she uses the remote controller to give an instruction to strengthen the compensation. In the case of this embodiment, the size of the gain by which the compensation data is multiplied is changed to a larger value.

Then, this procedure is repeated until the adjustment image that the person making the adjustment judges to be most favorable is displayed.

Note that this operation is not restricted to being performed through the remote controller. For example, it may also be performed through a control device provided to the image display device (e.g., an operation button 1306 provided to the front panel). It may also be performed through some other interface (e.g., an RS232 port 1308)

Further, in the case where there is fluctuation (i.e., individual differences) in the resistance values of the wirings in the display panel land fluctuation (i.e., individual differences) in the characteristics of the display elements, and therefore adjustments being performed at the time when the image display device is being manufactured, it is not necessary to provide the pattern generator 1303 as a part of the image display device. Rather, a pattern generator may be attached just when the adjustment is to be performed to perform the adjustment.

Note that a flash memory 1307 in FIG. 13 is provided to store the determined compensation conditions, so that the adjustment does not have to be performed all over again the next time that the power is turned on.

Note that in the above-mentioned embodiment, the compensation data is multiplied by the gain, as an example of the selected compensation condition. However, the present invention is not limited to this structure. For example, the right side of Equation in Equation 8 may be replaced with IF×β, and the value of β may be adjusted from the controller.

Note that this changes the value of the coefficient β by which the element current is to be multiplied. However, its meaning in a physical sense is that the value of the element current that is actually flowing is adjusted, and this adjusts the voltage drop amount used in calculating the compensation data.

Accordingly, the slight differences in the characteristics of the image display elements when the display panel is being manufactured, and the deterioration in the characteristics of the image display elements after the display panel has been used for a long time, can be adjusted favorably.

Further, in yet another construction, the compensation condition may determined by setting the contents of the curve that represents the relationship between the "voltage drop amount " and the "emission current amount" which is drawn in the table memory 110 (FIG. 20) for converting the voltage drop amount into the emission current.

Further, in yet another construction, the pattern stored in the pattern generator may be compensated image data that is produced when the wiring resistance value in Equation 6 used when calculating the voltage drop amount is made to be changeable value.

By adopting the above-mentioned configuration, excellent adjustment can be made despite the slight differences in the wire resistance values of the image display elements at the time when the display panel is manufactured.

Second Embodiment

In accordance with the first embodiment, the discrete image data reference values are set with respect to the inputted image data and the reference points are set along the row wirings. Then, the compensation data for the image data having the sizes of the image data reference values is calculated.

Further, the compensation was achieved by interpolating between the discretely calculated compensation data, calculating the compensation data that is appropriate for the horizontal display position of the inputted image data and for the size of the image data displayed at that horizontal display position and adding to the image data.

On the other hand, a similar compensation may be performed with the following construction which is different from the above-mentioned construction.

The result obtained when the image data is compensated (i.e., the above-mentioned sum of the discrete compensation data plus the image data reference value) may calculate for the discrete horizontal position and for the image data reference value. Then, the discretely calculated compensation result may be interpolated to calculate the compensation result for inputted display image according to its horizontal display position and its size at that horizontal display position. Then, the modulation may be performed according to this compensation result.

In accordance with this construction, it is not necessary to add the interpolated image data and the compensation data together when performing the discrete calculation of the compensation result, since the image data and the compensation data have been added together in advance.

In accordance with the image display device according to the embodiment described above, the influence from the voltage drops caused by the resistance in the scanning wirings can be compensated excellently.

Further, in accordance with the method for adjusting the image display device, preferable compensation conditions can be set easily even when it is difficult to appraise the state of the compensation.

As described above, the present invention realizes an image display device and a method of adjusting the image display device, in which the compensation conditions can be determined preferably.

What is claimed is:

1. An image display device comprising:

image display elements used for displaying an image, which are driven via a plurality of row wirings and a plurality of column wirings constituting a matrix wiring;

a scanning circuit for sequentially selecting the wirings;

a modulation circuit for supplying to each of the plurality of column wirings a signal for modulating each of the plurality of image display elements connected to a row wiring selected by the scanning circuit;

a pattern output circuit for outputting image data for adjusting having been stored in advance;

a selection circuit for outputting image data inputted from an external of the image display device when performing a normal display, and outputting image data inputted from the pattern output circuit when adjusting a compensation condition; and a compensated image data calculation circuit for compensating image data inputted from the selection circuit to calculate compensated image data, wherein a compensation condition for making the compensation is selected according to an external control and the compensated image data calculation circuit calculates the compensated image data based on the selected compensation condition.

2. An image display device according to claim 1, further comprising a limiter for limiting so that compensated image data which is greater than a predetermined value is not inputted into the modulation circuit.

3. An image display device according to claim 1, wherein the compensated image data calculation circuit calculates compensated image data which is obtained by compensating the inputted image data, based on compensation data that is based on the inputted image data and based on the selected compensation condition.

4. An image display device according to claim 3, wherein the compensated image data calculation circuit further comprises a compensation data calculation circuit for calculating the compensation data, and an arithmetic circuit for computing the compensation data and the inputted image data.

5. An image display device according to claim 4, wherein the compensated image data calculation circuit further comprises an adjusting circuit for adjusting the value of the compensation data based on the selected compensation condition.

6. An image display device according to claim 5, wherein the adjusting circuit includes a multiplier, and sets a coefficient by which the compensation data is to be multiplied, based on the selected compensation condition.

7. An image display device according to claim 3, wherein the compensated image data calculation circuit divides the row wirings into a plurality of blocks according to a plurality of reference points set along the same row wiring, and generates the compensation data in correspondence with each of the reference points by predicting the voltage drop that will occur at each reference point based on a signal for driving the image display elements within each of the blocks.

8. An image display device according to claim 7, wherein the compensated image data calculation circuit sets magnitude of an element current used when calculating the voltage drop, based on the selected compensation condition.

9. An image display device according to claim 7, wherein the compensated image data calculation circuit sets the magnitude of wiring resistance in a scanning wiring used when calculating the voltage drop based on the selected compensation condition.

10. An image display device according to claim 7, wherein the compensated image data calculation circuit obtains the compensation data for positions other than the reference points by interpolating them from the compensation data corresponding to the plurality of reference points.

11. An image display device according to claim 3, wherein the compensated image data calculation circuit divides the row wiring into a plurality of blocks according to a plurality of reference points set along the same row wiring, and calculates the voltage drop that will occur at each reference point based on a signal driving the image display elements within each of the blocks, and wherein the compensated image data calculation circuit further comprises emitted current amount calculation means which receives input of a voltage drop amount and calculates an emitted current amount, and the compensated image data calculation circuit generates the compensation data for each of the reference points based on the obtained emitted current amount.

12. An image display device according to claim 11, wherein the emitted current amount calculation means is a look-up table in which the voltage drop amount is used as an input to output the voltage emitted current amount.

13. An image display device according to claim 11, wherein the compensated image data calculation circuit sets input/output characteristics of the emitted current amount calculation means for use when calculating a compensation amount, based on the selected compensation condition.

14. An image display device according to claim 3, wherein the modulation circuit is a circuit for generating a pulse width modulation signal in accordance with inputted data; and wherein the compensated image data calculation circuit predicts/calculates a voltage drop amount at a plurality of points in time set discretely within a period during which the scanning circuit selects one row wiring, predicts/calculates an emitted current drop amount caused by a voltage drop occurring when the image display elements are driven from the pulse width modulation start time until the plurality of discretely set points in time, and, calculates compensation data for supplementing the emitted current drop amount corresponding to each of the discretely set points in time.

15. An image display device according to claim 14, wherein the compensated image data calculation circuit obtains the compensated image data corresponding to points in time other than the plurality of discretely calculated points in time by interpolating them from the compensation data corresponding to the plurality of discretely calculated points in time.

16. An image display device according to claim 1, wherein the compensated image data calculation circuit calculates compensated image data which is obtained by compensating the inputted image data, based on compensation data for compensating for a voltage drop occurring in at least one of the row wiring and the column wiring, and based on the selected compensation condition.

17. An image display device according to claim 1, wherein the given image data for adjusting includes:

data for creating a first region and data for creating a fourth region, the first region and the fourth region being adjacent to each other in a direction that is perpendicular to a direction along which row wirings extend, both of the data for creating the first region and the data for creating the fourth region having gradation values not less than 50% of maximum gradation values and having substantially the same gradation values as each other;

data for creating a third region positioned with the fourth region along the direction of the row wirings; and data for creating a second region positioned with the first region along the direction of the row wirings, and wherein the data for creating the second region allows a greater voltage drop to occur in the row wirings than the data for creating the third region does.

18. An image display device according to claim 17, wherein the given image data for adjusting includes data which simultaneously puts at least 55% of all the elements on one row wiring which is overlap with the first region into a drive state.

19. An image display device according to claim 17, wherein the given image data for adjusting sets the first region and the fourth region as regions that start at positions that are apart from a power supply terminal from which a power is provided to the row wiring by a distance of at least 30% of the display screen along the direction of the row wiring.

20. An image display device according to any one of claims 1 through 19, wherein the image display elements are cold cathode elements.

21. An image display device according to claim 20, wherein the cold cathode elements are surface conduction electron-emitting devices.

22. A method of adjustment for an image display device, comprising:

image display elements used in an image display and being driven via a plurality of row wirings and a plurality of column wirings constituting a matrix wiring;

a scanning circuit for sequentially selecting the row wirings; and a modulation circuit for supplying to each of the plurality of column wirings a signal for modulating each of a plurality of image display elements that are connected to a row wiring selected by the scanning circuit, wherein said method is comprised by a step of displaying a plurality of adjustment images based on a plurality of adjustment data obtained by compensating for given image data for adjusting according to a plurality of different adjustment compensation conditions that are used during a normal display time;

a step of deciding one compensation condition, and a step of displaying image based on compensated image data obtained by compensating the inputted image data by said decided compensation condition.

23. A method of adjustment for an image display device according to claim 22, wherein the compensation includes dividing the row wirings into a plurality of blocks according to a plurality of reference points set along the same row wiring, calculating the voltage drop that will occur at each reference point based on a signal for driving the image display elements within each of the blocks, and using the compensation data obtained with respect to each reference point.

24. A method of adjustment for an image display device according to claim 23, wherein the compensation includes obtaining the compensation data for positions other than the reference points by interpolating them from the compensation data obtained for the plurality of reference points.

25. A method of adjustment for an image display device according to claim 24, wherein the modulation circuit is a circuit for generating a pulse width modulation according to inputted data, and in order to perform the compensation it generates a plurality of the compensation data each used respectively at a plurality of points in time which are set discretely within a period during which the scanning circuit selects one row wiring.

26. A method of adjustment for an image display device according to claim 25, wherein the compensation includes obtaining the compensation data for points in time other than the plurality of discretely set points in time, by interpolating the compensation data based on the compensation data determined with respect to the plurality of reference points.

* * * * *

UNITED STATES PATENT AND TRADEMARK OFFICE

CERTIFICATE OF CORRECTION

PATENT NO. : 6,870,522 B2
DATED : March 22, 2005
INVENTOR(S) : Osamu Sagano et al.

It is certified that error appears in the above-identified patent and that said Letters Patent is hereby corrected as shown below:

DRAWINGS,
Sheet 10, FIG. 9C, "COMPENSATH" should read -- COMPENSATE --.
Sheet 11, FIG. 10A, "NOT" should read -- NO --.
Sheet 11, FIG. 10C, "COMPENSION" should read -- COMPENSATION --.
Sheet 12, FIG. 11A, "NOT" should read -- NO --.
Sheet 12, FIG. 11C, "COMPENSION" should read -- COMPENSATION --.
Sheet 14, FIG. F13, "PARAMENTERS" should read -- PARAMETERS --.
Sheet 24, FIG. F23, "INTARVAL" should read -- INTERVAL --.

Column 6,
Line 55, "such-as" should read -- such as --.

Column 15,
Line 2, "coefficient a" should read -- coefficient $\alpha$ --.

Column 16,
Line 39, "wiring" should read -- wiring. --.

Column 17,
Line 44, "(i.e., $64\times\Delta t$), which can" should read -- (i.e., $64\times\Delta t$) can --.

Column 25,
Line 30, "form" should read -- from --.

Column 26,
Line 51, "an" should be deleted.

Column 27,
Line 50, "out putted" should read -- outputted --.

Column 28,
Line 37, "100a" should read -- 100b --.

Column 34,
Line 55, "port 1308)" should read -- port 1308). --.

UNITED STATES PATENT AND TRADEMARK OFFICE

CERTIFICATE OF CORRECTION

PATENT NO. : 6,870,522 B2
DATED : March 22, 2005
INVENTOR(S) : Osamu Sagano et al.

It is certified that error appears in the above-identified patent and that said Letters Patent is hereby corrected as shown below:

Column 35,
Line 21, "may determined" should read -- may be determined --.

Column 36,
Line 25, "adjusting" should read -- adjusting, --.

Column 38,
Line 22, "and" should be deleted; and
Line 29, "overlap" should read -- overlapped --.

Signed and Sealed this

Sixth Day of September, 2005

JON W. DUDAS
*Director of the United States Patent and Trademark Office*